US007513654B2

(12) United States Patent
Okada

(10) Patent No.: US 7,513,654 B2
(45) Date of Patent: Apr. 7, 2009

(54) LIGHTING DEVICE FOR VEHICLE

(75) Inventor: Noriko Okada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 106 days.

(21) Appl. No.: 11/433,598

(22) Filed: May 12, 2006

(65) Prior Publication Data

US 2006/0285347 A1 Dec. 21, 2006

(30) Foreign Application Priority Data

May 17, 2005 (JP) ..... 2005-143439

(51) Int. Cl.
*F21V 7/00* (2006.01)

(52) U.S. Cl. ..... 362/297; 362/507; 362/517; 362/518; 362/538; 362/540

(58) Field of Classification Search ..... 362/297, 362/507, 517, 518, 538, 540, 298, 303, 305, 362/346, 347, 800
See application file for complete search history.

(56) References Cited

U.S. PATENT DOCUMENTS

| | | | | |
|---|---|---|---|---|
| 3,629,570 | A * | 12/1971 | Bouthors et al. | 362/467 |
| 7,073,931 | B2 | 7/2006 | Ishida | |
| 2003/0214815 | A1* | 11/2003 | Ishida et al. | 362/516 |

FOREIGN PATENT DOCUMENTS

| | | |
|---|---|---|
| DE | 10 2004 005 931 | 8/2004 |
| JP | 4-212202 | 8/1992 |
| JP | 2001-332104 | 11/2001 |

OTHER PUBLICATIONS

Patent Abstracts of Japan, Publication No. 2001-332104, Publication Date: Nov. 30, 2001, 1 page.
Patent Abstracts of Japan, Publication No. 04-212202, Publication Date: Aug. 3, 1992, 1 page.
German Office Action dated Nov. 17, 2008, for patent application No.: 10 2006 023 163.5-54, and English translation thereof, 8 pages.

* cited by examiner

*Primary Examiner*—Sandra O'Shea
*Assistant Examiner*—Mark Tsidulko
(74) *Attorney, Agent, or Firm*—Osha • Liang LLP

(57) ABSTRACT

A lighting device for a vehicle has a light-emitting element disposed on an optical axis, a first reflection surface for reflecting light emitted from the light-emitting element in an outer radial direction of the optical axis, and a second reflection surface for reflecting the light reflected by the first reflection surface forward. A cross-sectional shape of the first reflection surface taken along a predetermined plane including the optical axis is an ellipse. The ellipse has a light-emitting center as a first focus and an axis line crossing the optical axis as a major axis. The second reflection surface is disposed between the first focus and a second focus of the ellipse. A cross-sectional shape of the second reflection surface taken along the predetermined plane is a parabola having the second focus of the ellipse as a focus and a point located forward of the focus as a vertex.

4 Claims, 18 Drawing Sheets

LIGHTING DEVICE FOR VEHICLE

BACKGROUND OF THE INVENTION

1. Technical Field

The present invention relates to a lighting device for a vehicle using a light-emitting element, such as a light-emitting diode, as a light source.

2. Related Art

Recently, a lighting device has been developed for a vehicle, such as a headlamp, using a light-emitting element, such as an LED, as a light source.

Disclosed in Patent Document 1 is a lighting device for a vehicle including a first reflection surface which reflects light from a light-emitting element disposed toward the lateral side of the lighting device toward the rear side of the lighting device, and a second reflection surface which reflects the light reflected from the first reflection surface toward the front side of the lighting device. In the lighting device disclosed in Patent Document 1, the first reflection surface is a rotary elliptic surface having the light-emitting center of the light-emitting element as a first focus and a point located next to the first focus as a second focus. In addition, the second reflection surface is a rotary parabolic surface having the second focus of the rotary elliptic surface as a focus.

Disclosed in Patent Document 2 is a lighting device for a vehicle having the same configuration as the above-described lighting device, but not having the light-emitting element as a light source.

[Patent Document 1] JP-A-2001-332104

[Patent Document 2] JP-A-4-212202

By using the lighting device for a vehicle disposed in Patent Document 1, or replacing the light source of the lighting device for a vehicle disclosed in Patent Document 2 with a light-emitting element, it is possible to increase the utilization rate of light flux from the light-emitting element and then to control irradiation of light.

However, the lighting device for a vehicle disclosed in Patent Document 1 and Patent Document 2 reflects light from the light source, and the light is converged at the second focus of the rotary elliptic surface forming the surface shape of the first reflection surface, and then the light is incident on the second reflection surface as a diverging light from the second focus. Consequently, the width in the forward and backward direction of the lighting device becomes large. For this reason, there is a problem in which a lighting device cannot be provided when a space for mounting the lighting device in the vehicle does not provide sufficient width in the forward and backward direction.

SUMMARY OF THE INVENTION

Embodiments of the present invention provide a lighting device for a vehicle having a light-emitting element as a light source, in which the width in the forward and backward direction of the lighting device can be made small by increasing the utilization rate of light flux from the light-emitting element.

In order to achieve the above-mentioned property, studies have been made in the configuration of the second reflection surface.

According to an aspect of one or more embodiments of the invention, a lighting device for a vehicle, includes: a light-emitting element disposed on an optical axis extending in a forward and backward direction of the lighting device; a first reflection surface for reflecting light, which is emitted from the light-emitting element, in an outer radial direction of the optical axis; and a second reflection surface for reflecting the light, which is emitted from the light-emitting element and reflected by the first reflection surface, in the forward direction. In this case, a cross-sectional shape of the first reflection surface taken along a predetermined plane including the optical axis is an ellipse, which has a light-emitting center of the light-emitting element as a first focus and an axis line crossing the optical axis as a major axis. Further, the second reflection surface is disposed between the first focus and a second focus of the ellipse. Furthermore, a cross-sectional shape of the second reflection surface taken along the predetermined plane is a parabola, which has the second focus of the ellipse as a focus and a point located ahead of the focus as a fixed point.

The kind of 'the lighting device for a vehicle' is not limited to the specific embodiments disclosed. For example, a headlamp, a fog lamp, a cornering lamp, a daytime running lamp, or the lighting device forming a part of these can be used.

If 'the optical axis' is an axis line extending in the forward and backward direction of the lighting device, the optical axis may correspond or not correspond with the axis line extending in the forward and backward direction of the vehicle.

'The light-emitting element' means a light source formed in an element shape having a lighting emitting chip emitting light in a point pattern, the kind of light-emitting element is not limited. For example, a light-emitting diode or a laser diode can be used.

'The outer radial direction of the optical axis' means a direction deviated from the optical axis, the direction is not specifically defined.

If the cross-sectional shape of 'the first reflection surface' taken along the predetermined plane including the optical axis is an ellipse having the light-emitting center of the light-emitting element as the first focus and the axis line crossing the optical axis as a major axis, a cross-sectional shape taken along the plane orthogonal to the predetermine plane is not specifically defined.

If the cross-sectional shape of 'the second reflection surface' taken along the predetermined plane is a parabola having the second focus of the ellipse as a focus and a point located ahead of the focus as a fixed point, a cross-sectional shape taken along the plane orthogonal to the predetermine plane is not specifically defined.

The parabola forming the cross-sectional shape of 'the second reflection surface' taken along the predetermined plane may have an axis extending parallel to the optical axis as its axis, or may have an axis crossing the optical axis.

As shown in the above-described configuration, in the lighting device for a vehicle according to the above aspect of one or more embodiments of the invention, the first reflection surface reflects light from the light-emitting element disposed on the optical axis extending in the forward and backward direction of the lighting device in the outer radial direction of the optical axis, and then the second reflection surface reflects the light in the forward direction. Here, the cross-sectional shape of the first reflection surface taken along the predetermined plane including the optical axis is the ellipse having the light-emitting center of the light-emitting element as the first focus and the axis line crossing the optical axis as the major axis. The second reflection surface is disposed between the first focus and the second focus of the ellipse. The cross-sectional shape of the second reflection surface taken along the predetermined plane is the parabola having the second focus of the ellipse as the focus and the point located ahead of the focus as the fixed point. Therefore, it is possible to achieve the following operational effects.

Within the predetermined plane, the first reflection surface 14*a* reflects light from the light-emitting element, and the light is converged at the second focus of the ellipse. However, since the second reflection surface is disposed between the first focus and the second focus, the light is incident on the second reflection surface before being converged at the second focus. The cross-sectional shape of the second reflection surface taken along the predetermined plane is the parabola having the second focus as its focus, and the point located ahead of the focus as its fixed point. Accordingly, the second reflection surface reflects the light reflected by the first reflection surface in the forward direction, thereby making the light become a light beam parallel to the axis of the parabola.

With the configuration of the second reflection surface in which a diverging light from the second focus is not reflected in the forward direction but light before being converged at the second focus is reflected in the forward direction, it is unnecessary to form the second reflection surface to significantly protrude behind the second focus as shown in the related art. Accordingly, the width of the lighting device in the forward and backward direction can be made small.

According to the above aspect of one or more embodiments of the invention, the width in the forward and backward direction of the lighting device can be made small by increasing the utilization rate of light flux from the light-emitting element, in the lighting device for a vehicle having the light-emitting element as the light source. Accordingly, even though a space for mounting the lighting device in the vehicle is not sufficiently large, the lighting device can be easily provided in the limited space.

In the above-described configuration, if the first reflection surface is formed of a rotary elliptic surface in which the major axis of the ellipse forming the cross-sectional shape taken along the predetermined plane is a central axis, and the second reflection surface is formed of a rotary parabolic surface in which the axis of the parabola forming the cross-sectional shape taken along the predetermined plane is a central axis, the light from the light-emitting element that is consecutively reflected by the first and second reflection surfaces generates a bright spot-shaped light distribution pattern. Moreover, by using this configuration, not only the width of the lighting device in the forward and backward direction but also the width in a direction orthogonal to the optical axis can be made small.

Instead of this configuration, a bright spot-shaped light distribution pattern may be formed, as a cross-sectional shape of the first reflection surface taken along a plane including the major axis of the ellipse forming the cross-sectional shape taken along the predetermined plane and orthogonal to the predetermined plane is a parabola having the light-emitting center of the light-emitting element as a focus, and the second reflection surface is formed of a parabolic surface including the focus of the parabola forming the cross-sectional shape taken along the predetermined plane and having an axis line orthogonal to the predetermined plane as a focal line. Moreover, by using this configuration, the light reflected by each place of the first reflection surface is incident on the second reflection surface 14*b* in a parallel pattern when seen from the front view of the lighting device. Therefore, even though the positional relationship between the first reflection surface and the second reflection surface is deviated from the focal line, it is possible to form the desired light distribution pattern.

Instead of this configuration, a bright spot-shaped light distribution pattern may be formed, as the first reflection surface is formed of a curved surface formed by rotating the ellipse forming the cross-sectional shape of the predetermined plane around the optical axis, and the second reflection surface is formed of a curved surface formed by rotating the parabola forming the cross-sectional shape of the predetermined plane around the optical axis. Moreover, by using this configuration, the second reflection surface can be formed in a circular ring shape, when seen from the front view of the lighting device. Accordingly, the light distribution pattern has balanced luminous intensity distribution along the entire periphery of the pattern.

In the above-described configuration, the first and second reflection surfaces may be separately formed on the surface of each reflector. However, if the first and second reflection surfaces are formed on the surface of a single translucent block, the lighting device can be made thin, and the positional relationship between the first reflection surface and the second reflection surface can improve accuracy.

When this configuration is used, since the translucent block outputs the light reflected by the second reflection surface, it is possible to control diffusion and deviation of the light output from the translucent block, by properly forming the surface shape of the output surface. Therefore, it is possible to easily form the desired light distribution pattern.

Moreover, since the light reflected by the second reflection surface arrives at the output surface of the translucent block in a parallel pattern, even though the position of the output surface is deviated in the forward and backward direction, the translucent block outputs the light without changing the direction of the light. Therefore, it is possible to properly adjust the position of the output surface of the translucent block in accordance with the shape of the space for mounting the lighting device in the vehicle. Accordingly, it is possible to increase the degree of freedom in the layout of the lighting device.

DETAILED DESCRIPTION

Hereinafter, embodiments of the invention will be described with reference to the accompanying drawings.

First, a first embodiment of the invention will be described.

Figure 1:
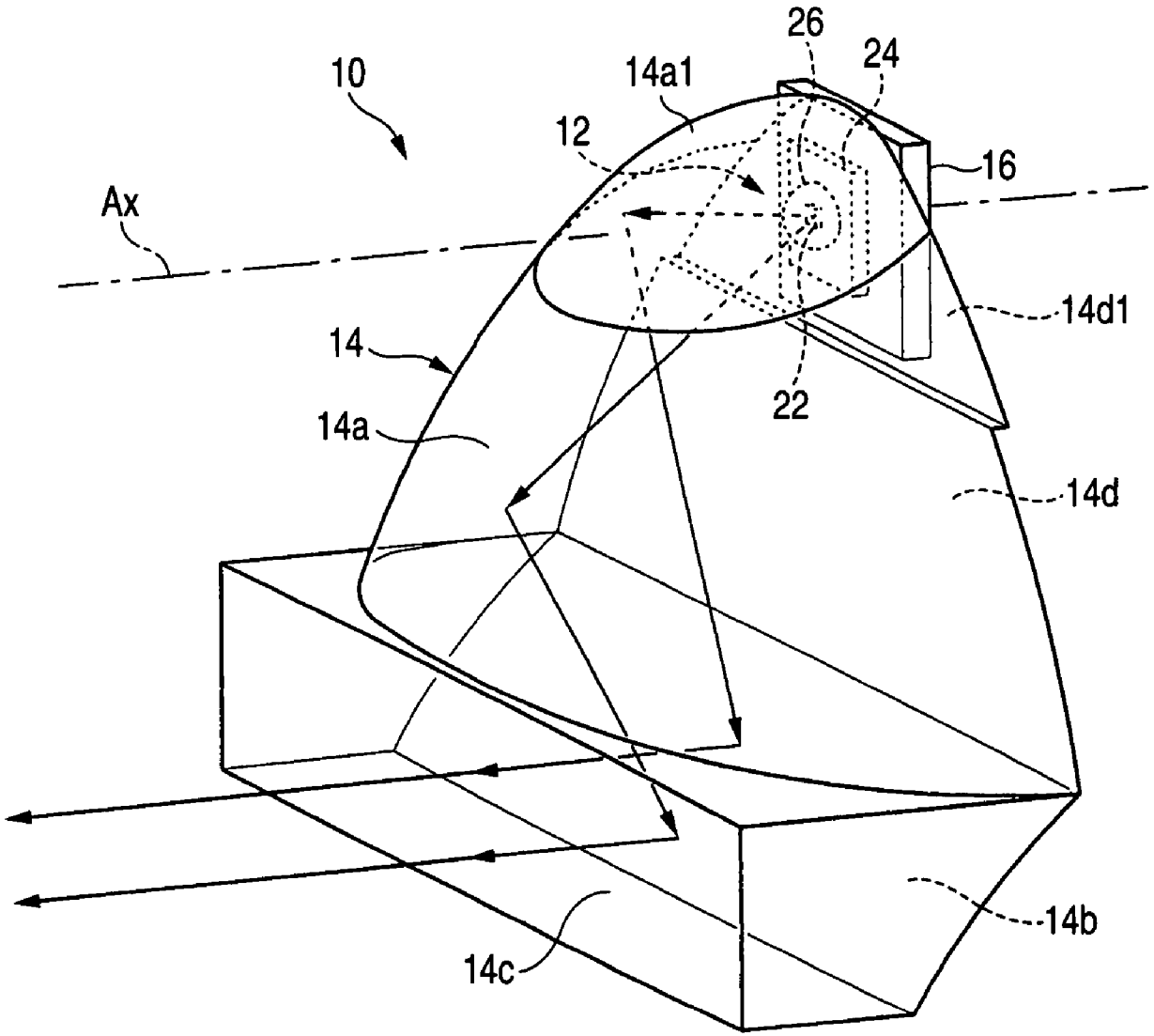
FIG. 1 is a perspective view showing a lighting device for a vehicle according to a first embodiment of the invention.
Figure 2:
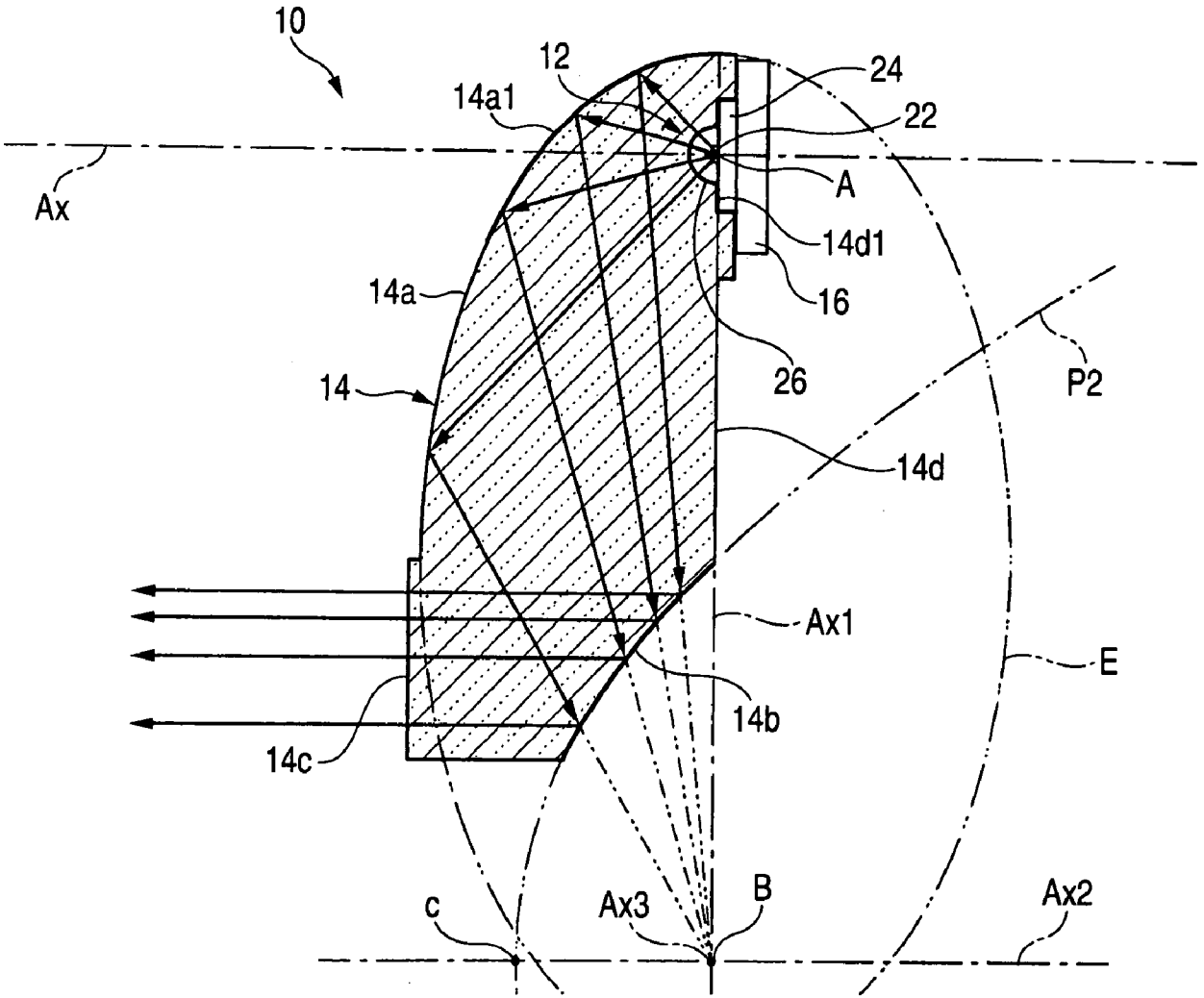
FIG. 2 is a cross-sectional side view showing the lighting device for a vehicle.
Figure 3:
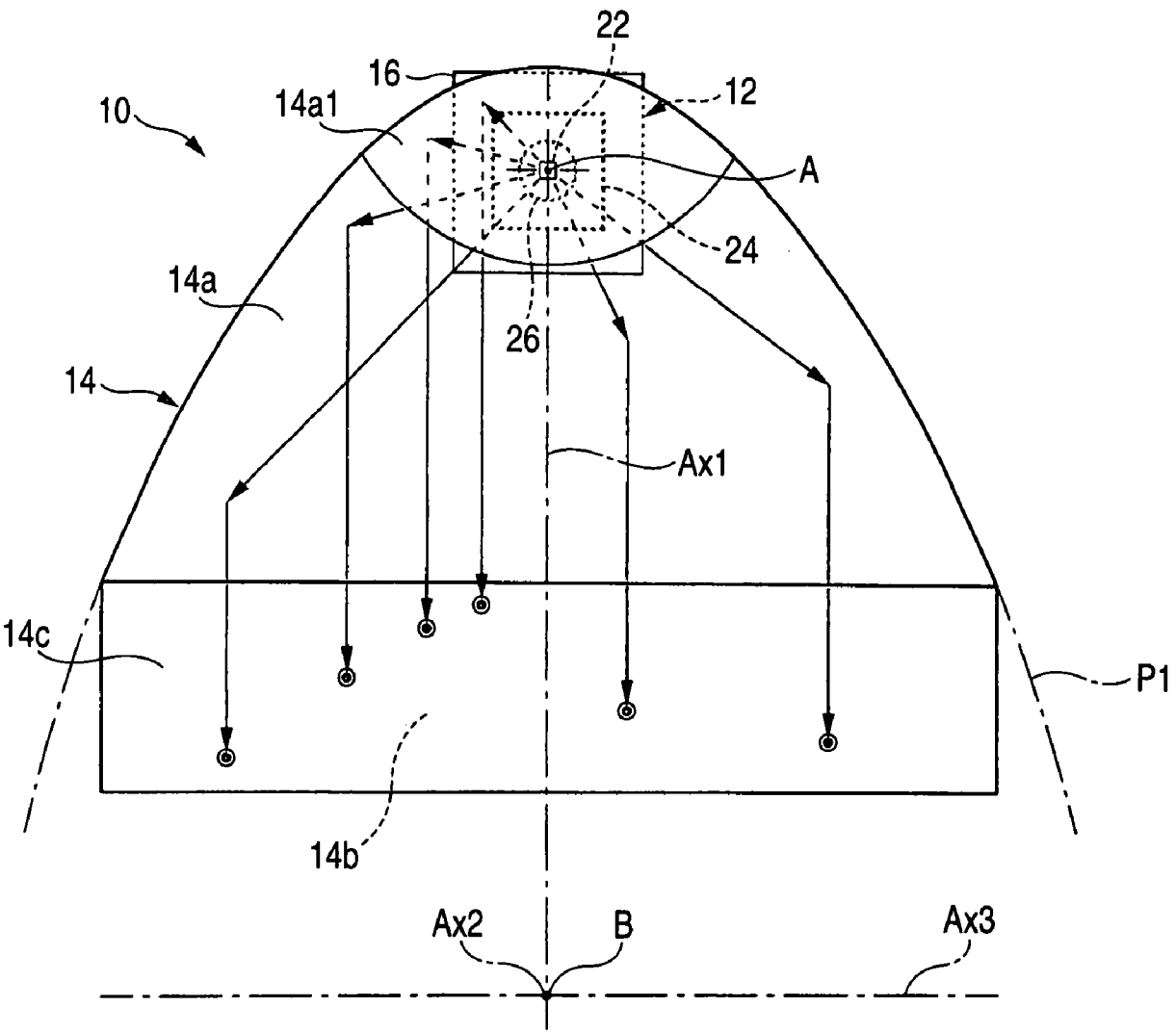
FIG. 3 is a front view showing the lighting device for a vehicle.

FIG. 1 is a perspective view of a lighting device for a vehicle 10 according to a first embodiment of the invention, FIG. 2 is a cross-sectional side view thereof, and FIG. 3 is a front view thereof.

As shown in the FIG. 1 to 3, the lighting device for a vehicle 10 is a lighting device unit that is used in a state built in a headlamp for high beam, and includes a light-emitting element 12 and a translucent block 14 made of transparent resin materials. The light-emitting element 12 is disposed in a forward direction of the lighting device on an optical axis Ax extending in the forward and backward direction of the lighting device. The translucent block 14 covers the forward side of the light-emitting element 12. While the lighting device 10 is built in the headlamp, its optical axis Ax extends in a forward and backward direction of a vehicle.

The light-emitting element 12 is a white light-emitting diode, and includes a light-emitting chip 22 having the size in the range of 0.3 to 3 mm on all sides in the front view, a base member 24 having the light-emitting chip 22 mounted thereon, and a sealing resin member 26 which seals the light-emitting chip 22. The light-emitting element 12 is fixed to a rear surface 14*d* of the translucent block 14 by a supporting plate 16 made of metal.

The translucent block 14 is formed such that the optical axis Ax is orthogonal to the rear surface 14*d* of the translucent block 14, and a light source mounting part 14*d*1 is formed on an upper side of the rear surface 14*d* so as to mount the light-emitting element 12 thereon. The light source mounting part 14*d*1 is formed in an uneven shape modeled after the surface shape of the light-emitting element 12. Accordingly, the light-emitting chip 22 is positioned on the optical axis Ax, and the sealing resin member 26 comes in close contact with the translucent block 14.

The front surface of the translucent block 14 is formed with a first reflection surface 14*a*, which reflects light from the light-emitting element 12 toward a lower side of the optical axis Ax. In addition, a second refection surface 14*b* is formed on a lower side of the rear surface 14*d* of the translucent block 14 so as to reflect the light from the light-emitting element 12 reflected by the first reflection surface 14*a* in the forward direction. Further, an output surface 14*c* is formed at a position located beneath the first reflection surface 14*a* of the front surface of the translucent block 14 so as to output the light from the first reflection surface 14*a* that is reflected by the second reflection surface 14*b* in the forward direction from the translucent block 14.

The reflection surface 14*a* is formed such that its cross-sectional shape in a vertical plane (hereinafter, referred to as 'a predetermined plane' in the present embodiment) including the optical axis Ax is an ellipse E. The light-emitting center (that is, the center of the light-emitting chip 22) of the light-emitting element 12 is arranged on a first focus A of the ellipse of the reflection surface 14*a*, and a second focus B of the ellipse is located vertically below the first focus A. In addition, a cross-sectional shape taken along a plane (to which the optical axis Ax is orthogonal, in the present embodiment), which includes a major axis Ax1 of the ellipse E of the first reflection surface 14*a* and orthogonal to the predetermined plane, is a parabola P1 having the light-emitting center A of the light-emitting element 12 as its focus. The first reflection surface 14*a* is formed such that its lower edge extends up to a horizontal plane including the center of the ellipse E. Most of the light from the light-emitting element 12 that is incident to the first reflection surface 14*a* has an incident angle more than a critical angle. On the other hand, an incident angle at which the light enters an upper region of the first reflection surface 14*a* is less than the critical angle. Therefore, the upper region 14*a*1 is treated with mirror finishing, such as aluminum deposition.

The second reflection surface 14*b* is disposed between the first focus A and the second focus B. A cross-sectional shape of the second reflection surface 14*b* taken along the predetermined plane is a parabola P2 having the second focus B of the ellipse E as its focus, an axis line Ax2 extending parallel to the optical axis Ax as its axis, and a point C positioned ahead of the focus B as its fixed point. Here, the focal distance of the parabola P2 is set to a value obtained when the parabola P2 meets with the center of the ellipse E.

The second reflection surface 14*b* is a parabolic surface made by extending the cross-sectional shape of the parabola P2 in a horizontal direction, and is formed by performing mirror finishing, such as aluminum deposition, on the surface of the translucent block 14. Here, a focal line of the parabolic surface is an axis line Ax3 including the focus B and orthogonal to the predetermined plane. In addition, the second reflection surface 14*b* is formed such that its lower edge extends up to a horizontal surface including a point located substantially in the middle between the center of the ellipse E and the second focus B. The second reflection surface 14*b* has a rectangular shape elongated in a transverse direction when seen from the front view of the lighting device.

The output surface 14*c* is located slightly ahead of the first reflection surface 14*a*, and is a flat surface along a vertical surface orthogonal to the optical axis Ax. The output surface 14*c* is formed in a rectangular shape, which overlaps with the second reflection surface 14*b* when seen from the front view of the lighting device.

Hereinafter, the operation of the present embodiment will be described.

Within the predetermined plane, the first reflection surface 14*a* reflects light from the light-emitting element 12 downward, and the light is converged at the second focus B of the ellipse E located therebelow. However, since the second reflection surface 14*b* is disposed between the first focus A and the second focus B, the light is incident on the second reflection surface 14*b* before being converged at the second focus B. The cross-sectional shape of the second reflection surface 14*b* taken along the predetermined plane is the parabola P2, which has the second focus B as its focus and the point C located ahead of the focus B as its fixed point. Accordingly, the second reflection surface 14*b* reflects the light, which is emitted from the light-emitting element 12 and reflected by the first reflection surface 14*a*, in the forward direction, thereby making the light become a light beam parallel to the axis Ax2 of the parabola P2. Here, since the axis Ax2 of the parabola P2 extends parallel to the optical axis Ax, the light reflected by the second reflection surface 14*b* becomes parallel to the optical axis Ax.

Since the cross-sectional shape including the major axis Ax1 of the ellipse E of the first reflection surface 14*a* and taken along the plane orthogonal to the predetermined plane is the parabola P1 having the light-emitting center A of the light-emitting element 12 as its focus, the first reflection surface 14*a* reflects light from the light-emitting element 12 at each place of the first reflection surface 14*a*, and the light is incident on the second reflection surface 14*b* as a parallel light when seen from the front view of the lighting device. In addition, since the second reflection surface 14*b* is the parabolic surface whose focal line is the axis line Ax3 including the second focus B of the ellipse E and orthogonal to the predetermined plane, the light reflected by each place of the first reflection surface 14*a* is incident on the second reflection surface 14*b* in a parallel pattern when seen from the front view of the lighting device, and the second reflection surface 14*b* reflects the light in the forward direction, thereby making all the light parallel to the axis Ax2 of the parabola P2, that is, parallel to the optical axis Ax, and thus the light reaches the output surface 14*c*. Since the output surface 14*c* is formed of a plane taken along the vertical surface to which the optical axis Ax is orthogonal, the light reflected by the second reflection surface 14*b* travels as it is without being refracted through the output surface 14*c*, thus being irradiated ahead of the lighting device in a state parallel to the optical axis Ax.

Figure 4:
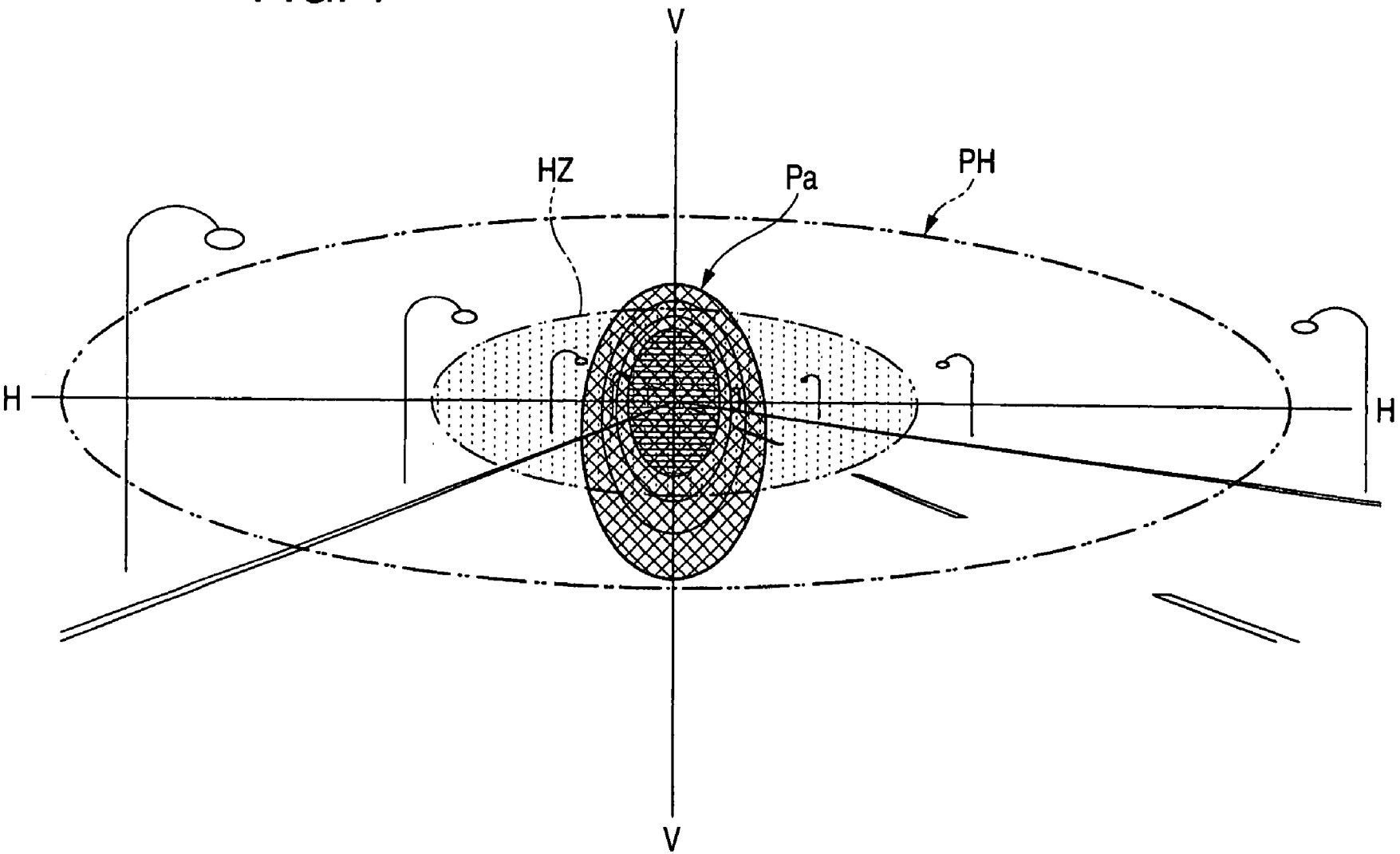
FIG. 4 is a perspective view showing light distribution pattern formed onto a virtual vertical screen disposed 25 m ahead of a vehicle, when the lighting device for a vehicle irradiates light in a forward direction.

FIG. 4 is a perspective view showing a light distribution pattern formed onto a virtual vertical screen disposed 25 m ahead of a vehicle, when the lighting device 10 for a vehicle irradiates light in the forward direction.

As shown in FIG. 4, a light distribution pattern Pa is formed as a part of a high-beam light distribution pattern PH indicated by a two-dot chain line.

The high-beam light distribution pattern PH is formed by light irradiated from the entire high-beam headlamp including the lighting device 10 for a vehicle, has a light distribution pattern diffused in a transverse direction with respect to H-V serving as a vanishing point in the forward direction of the lighting device, and has a hot zone HZ elongated in the transverse direction at the center.

Since the light distribution pattern Pa is involved in forming the hot zone HZ in the high-beam light distribution pattern P, the light distribution pattern Pa is formed in a spot-like light distribution pattern with respect to the H-V. The light distribution pattern Pa is a vertically elongated pattern, and its lower portion shows more gradual difference in luminous intensity distribution than its upper portion.

The cross-sectional shape of the plane orthogonal to the predetermined plane of the first reflection surface 14*a* is the parabola P2, and the second reflection surface 14*b* is the parabolic surface. Therefore, the light distribution pattern Pa is formed in a vertically elongated pattern, and its lower portion shows more gradual difference in luminous intensity distribution than its upper portion.

The light distribution pattern Pa is composed of a plurality of contour lines concentrically formed to the silhouette of the pattern Pa, and the contour line indicates the same luminous intensity. The light distribution pattern Pa has a luminous intensity that is gradually increased toward the center from a periphery thereof.

As described hereinabove in detail, in the lighting device 10 for a vehicle, the first reflection surface 14*a* covering the front side of the light-emitting element 12 reflects light from emitted the light-emitting element 12 downward of the optical axis Ax, the light-emitting element 12 is disposed on the optical axis Ax extending in the forward and backward direction of the lighting device, and then the second reflection surface 14*b* reflects the light in the forward direction. Here, the cross-sectional shape of the first reflection surface 14*a* taken along the predetermined plane is the ellipse E which has the light-emitting center A of the light-emitting element 12 as its first focus, and the axis Ax1 orthogonal to the optical axis Ax as its major axis. The second reflection surface 14*b* is disposed between the first focus A and the second focus B of the ellipse E. The cross-sectional shape of the second reflection surface 14*b* taken along the predetermined plane is the parabola P2 having the second focus B of the ellipse E as its focus, the axis line Ax2 extending parallel to the optical axis Ax as its axis, and the point C positioned ahead of the focus B as its fixed point. Therefore, it is possible to achieve operational effects to be described below.

In other words, within the predetermined plane, the first reflection surface 14*a* reflects light emitted from the light-emitting element 12, and the light is converged at the second focus B of the ellipse E located therebelow. However, since the second reflection surface 14*b* is disposed between the first focus A and the second focus B, the light is incident on the second reflection surface 14*b* before being converged at the second focus B. The cross-sectional shape of the second reflection surface 14*b* taken along the predetermined plane is the parabola P2 having the second focus B as its focus, and the point C located ahead of the focus B as its fixed point. Accordingly, the second reflection surface 14*b* reflects the light reflected by the first reflection surface 14*a* in the forward direction, thereby making the light into a light beam parallel to the axis Ax2 of the parabola P2, that is, a light beam parallel to the optical axis Ax.

In this way, the second reflection surface 14*b* is configured such that the light diverged from the second focus B is not reflected in the forward direction, but the light is reflected in the forward direction before being converged at the second focus B. Accordingly, it is unnecessary for the second reflection surface 14*b* to be formed to protrude in the backward direction of the second focus B. Therefore, the width in the forward and backward direction of the lighting device 10 can be made small.

According to the present embodiment, in the lighting device 10 for a vehicle having the light-emitting element 12 as a light source, the width in the forward and backward direction of the lighting device 10 can be made small by increasing the utilization rate of light flux from the light-emitting element 12. Accordingly, even though a space for mounting the lighting device in the vehicle is not sufficiently large, the lighting device 10 can be easily provided in the limited space.

In addition, in the lighting device 10 according to the present embodiment, the cross-sectional shape of the first reflection surface 14*a* including the major axis Ax1 of the ellipse E of the first reflection surface 14*a* and taken along the plane orthogonal to the predetermined plane is the parabola P1 having the light-emitting center A of the light-emitting element 12 as its focus, and the second reflection surface 14*b* including the focus B of the parabola P2 is the parabolic surface having the axis line Ax3 orthogonal to the predetermined surface as its focal line. Therefore, the light is traveling from the first reflection surface 14*a* to the second reflection surface 14*b* in a parallel pattern when seen from the front view of the lighting device. For this reason, even though the positional relationship between the first reflection surface 14*a* and the second reflection surface 14*b* is deviated from the focal line direction, the light reflected by the second reflection surface 14*b* can be kept in parallel to the optical axis Ax.

In addition, in the lighting device 10 for a vehicle according to the present embodiment, the first and second reflection surfaces 14*a* and 14*b* are formed on the surface of the single translucent block 14. Therefore, as compared to the configuration in which the first and second reflection surfaces are separately formed on each reflector, the lighting device 10 can be made thin, and the positional relationship between the first reflection surface 14*a* and the second reflection surface 14*b* can improve accuracy.

Here, the output surface 14*c* of the translucent block 14 is the flat surface taken along the vertical surface to which the optical axis Ax is orthogonal. Therefore, the light translucent block 14 can output the light reflected by the second reflection surface 14*b* as it is, thus the light is output in a state parallel to the optical axis Ax. Therefore, a light distribution pattern Pa can be formed in a bright spot shape.

In the above-described embodiment, the light-emitting chip 22 of the light-emitting element 12 is formed in a rectangular square having the size in the range of 0.3 to 3 mm on all sides. However, in other embodiments, the light-emitting chip 22 can be formed in any external shape (for example, a transversely elongated rectangle) besides a rectangular square.

In one or more embodiments, instead of using the sealing resin member 26, the translucent block 14 can directly seal the light-emitting chip 22.

In the above-described embodiment, the lighting device 10 for a vehicle is a part of the high beam headlamp. However, it can be a part of a low beam headlamp. In addition, it can be configured as an individual lighting device different from the headlamp, for example, as a cornering lamp. Here, in the above-described embodiment, the lighting device 10 is used in a state facing in the forward direction of the vehicle. However, the lighting device 10 for a vehicle can be used in a state inclined outside in a vehicle width direction by a predetermined angle. In this case, the lighting device 10 for a vehicle can be properly used as the cornering lamp or the like.

Hereinafter, various modifications to embodiments of the invention will be described. Those skilled in the art will appreciate that other modifications also exist.

First, a first modification of the first embodiment will be described.

Figure 5:
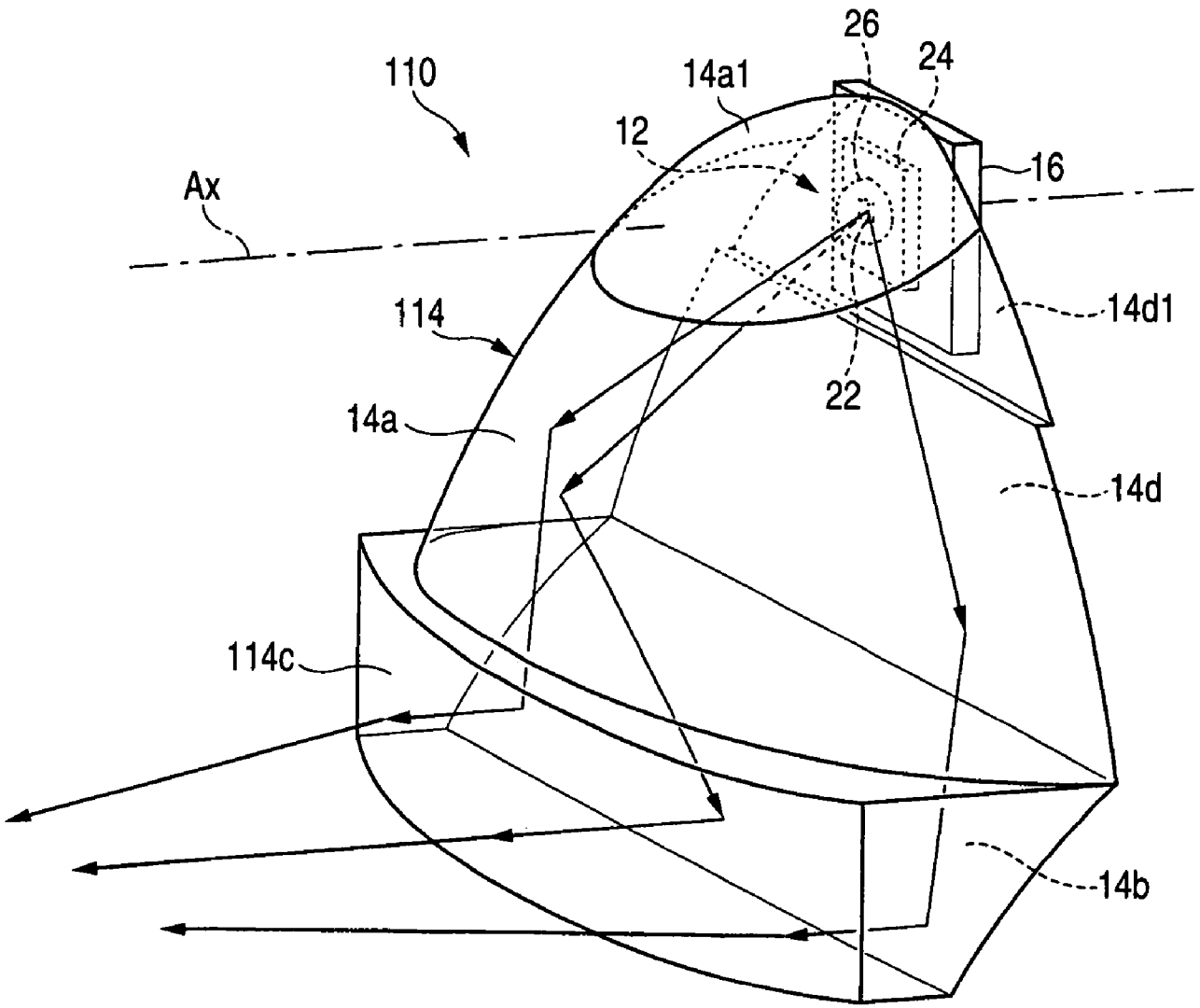
FIG. 5 is a perspective view showing a lighting device according to a first modification of the embodiment.

FIG. 5 is a perspective view showing a lighting device 110 according to the first modification.

As shown in FIG. 5, the lighting device 110 has differences in the shape of an output surface 114*c* of a translucent block 114, as compared to the first embodiment. The other parts are almost the same as that of the first embodiment.

That is, the output surface 114*c* has the same cross-sectional shape taken along the vertical plane including the optical axis Ax as the output surface 14*c*, but the output surface 114*c* has a convex arc shape in the horizontal cross-sectional view, which is different from the output surface 14*c* according to the first embodiment. Accordingly, the output surface 114*c* does not diffuse the light traveling from the second reflection surface 14*b* to the output surface 114*c* in the parallel pattern in a vertical direction, but diffuse the light in a transverse direction after the light is converged at the output surface so as to output the light.

Figure 6:
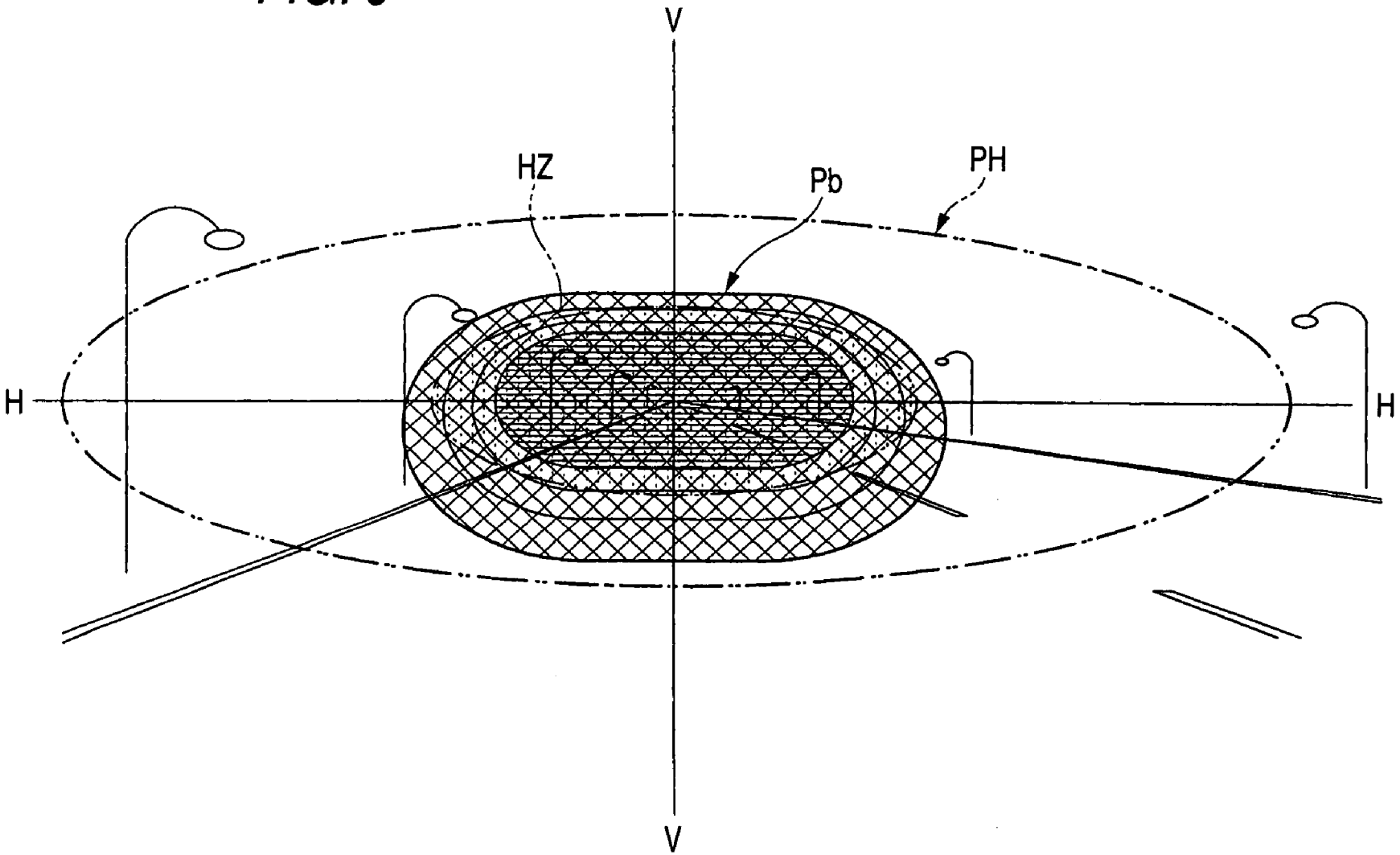
FIG. 6 is a perspective view showing a light distribution pattern formed onto the virtual vertical screen, when the lighting device for a vehicle according to the first modification irradiates light in the forward direction.

FIG. 6 is a perspective view showing a light distribution pattern Pb formed onto a virtual vertical screen disposed 25 m ahead of the vehicle, when the lighting device 110 for a vehicle according to the first modification irradiates light in the forward direction.

As shown in FIG. 6, the light distribution pattern Pb is formed in a shape as if the light distribution pattern Pa formed in the first embodiment is elongated in the transverse direction, as a result of transverse diffusion of the output surface 114*c* toward the both sides thereof. Accordingly, the transversely elongated light distribution pattern Pb does not generate an uneven light distribution on a road surface ahead of the vehicle, and is involved in forming the hot zone HZ of the high beam light distribution pattern PH.

Instead of forming the horizontal cross-sectional shape of the output surface 114*c* of the translucent block 114 according to the first modification in a convex arc shape, the horizontal cross-sectional shape of the output surface 114*c* can be formed in arc shapes, such as convex, concave, and wave shape that is formed by joining convex and concave shapes.

Hereinafter, a second modification of the first embodiment will be described.

Figure 7:
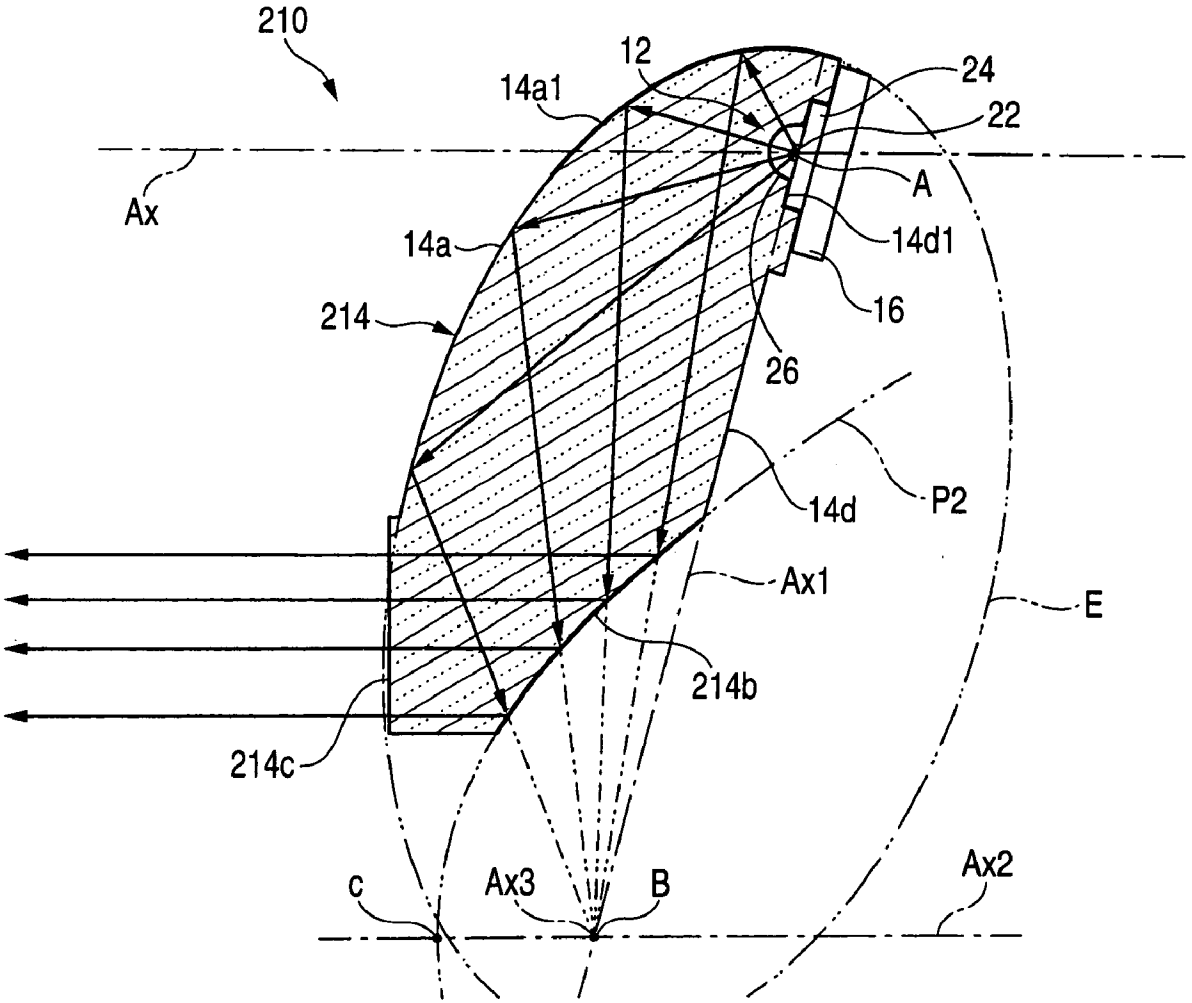
FIG. 7 is a cross-sectional side view showing a lighting device according to a second modification of the embodiment.

FIG. 7 is a cross-sectional side view showing a lighting device 210 according to the second modification.

As shown in FIG. 7, the lighting device 210 for a vehicle has the same configuration as the lighting device 10 for a vehicle according to the first embodiment in its fundamental structure. The lighting device 210 is disposed to be inclined in the backward direction. Accordingly, a translucent block 214 has a different configuration in part from the translucent block 14 according to the first embodiment.

The translucent block 214 is formed such that the major axis Ax1 of the ellipse E forming the cross-sectional shape of the first reflection surface 14*a* taken along the predetermined plane is rotated clockwise with respect to the light-emitting center A of the light-emitting element 12. The second reflection surface 214*b* of the translucent block 214 is formed such that the axis Ax2 of the parabola P2 forming the cross-sectional shape of the second translucent block 214*b* taken along the predetermined plane is kept in parallel to the optical axis Ax. In addition, the output surface 214*c* of the translucent block 214 is a flat surface taken along the vertical surface to which the optical axis Ax is orthogonal.

In the lighting device 210 for a vehicle, within the predetermined plane, the first reflection surface 14*a* reflects light from the light-emitting element 12 in a downwardly inclined direction, and the light is converged at the second focus B of the ellipse E located in a forwardly inclined direction. However, since the second reflection surface 214*b* is disposed between the first focus A and the second focus B of the ellipse E, the light is incident on the second reflection surface 214*b* before being converged at the second focus B. The cross-sectional shape of the second reflection surface 214*b* taken along the predetermined plane includes the Ax2 parallel to the optical axis Ax and is the parabola P2 having the second focus B as its focus, and the point C located ahead of the focus B as its fixed point. Accordingly, the second reflection surface 214*b* reflects the light reflected by the first reflection surface 14*a* in the forward direction, thereby making the light into a light beam parallel to the axis Ax2 of the parabola P2, that is, parallel to the optical axis Ax. The light reflected by the second reflection surface 214*b* travels as it is without refraction through the output surface 214*c*, thus being irradiated ahead of the lighting device in a state parallel to the optical axis Ax.

The same operational effects as that of the first embodiment can be achieved, even though the first reflection surface

14*a* is disposed in a backwardly inclined direction as shown in the lighting device 210 for a vehicle according to the modification while the second reflection surface 214*b* and the output surface 214*c* are disposed without inclination.

The same effects as that of the first embodiment can be achieved by disposing the second reflection surface and the output surface without inclination even when the first reflection surface is disposed in the forwardly inclined direction, on the contrary to that of the lighting device 210 for a vehicle according to the modification.

Hereinafter, a third modification of the first embodiment will be described.

Figure 8:
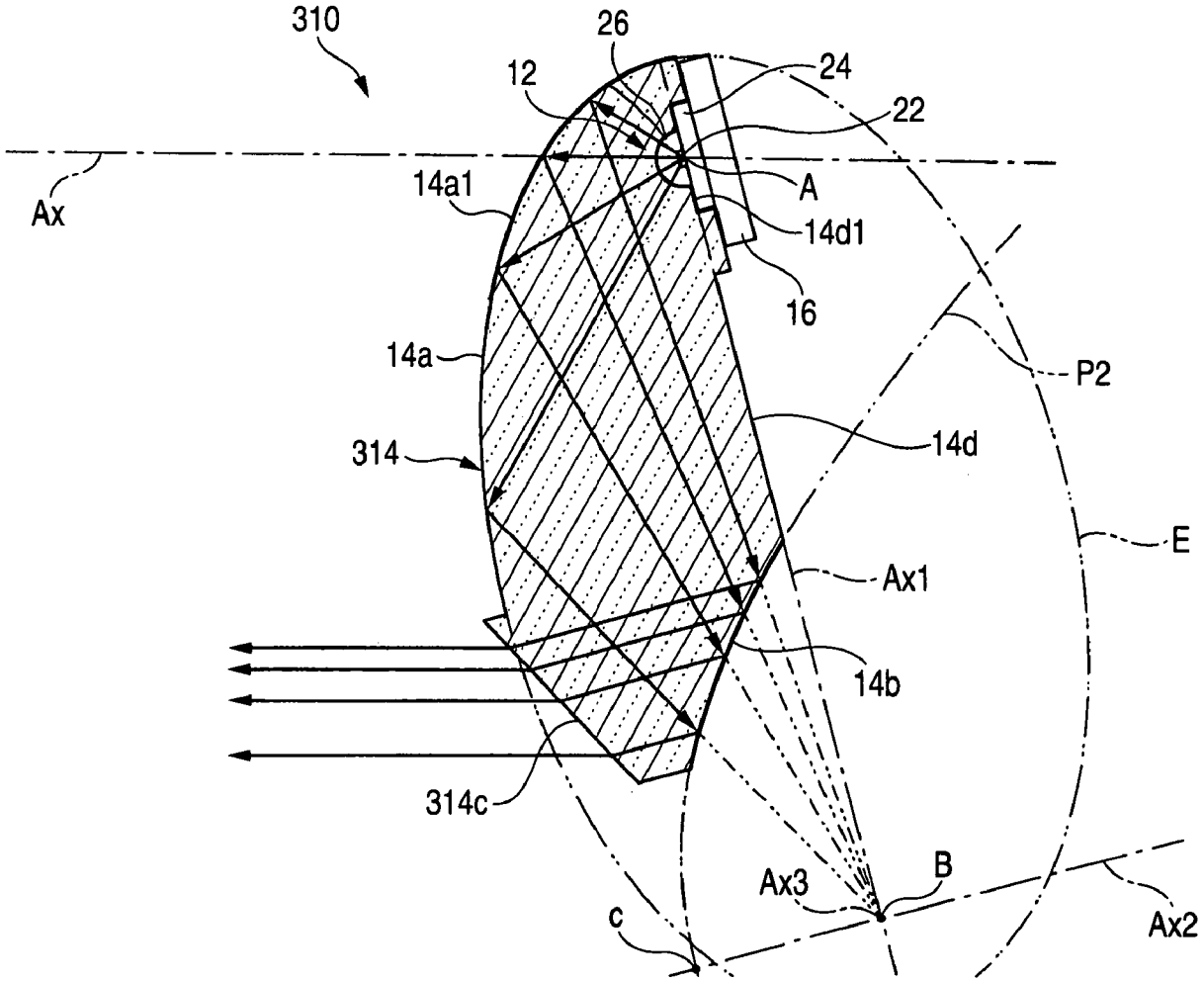
FIG. 8 is a cross-sectional side view showing a lighting device according to a third modification of the embodiment.

FIG. 8 is a cross-sectional side view showing a lighting device 310 according to the third modification.

As shown in FIG. 8, the lighting device 310 for a vehicle has the same configuration as the lighting device 10 for a vehicle according to the first embodiment in its fundamental structure. The lighting device 310 is disposed to be inclined in the forward direction. Accordingly, a translucent block 314 has a different configuration in part from the translucent block 14 according to the first embodiment.

The translucent block 314 is formed such that the major axis Ax1 of the ellipse E forming the cross-sectional shape of the first reflection surface 14*a* taken along the predetermined plane is rotated counter-clockwise with respect to the light-emitting center A of the light-emitting element 12. The second reflection surface 14*b* of the translucent block 314 is formed such that the axis Ax2 of the parabola P2 forming the cross-sectional shape of the second translucent block 14*b* taken along the predetermined plane is inclined downward with respect to the optical axis Ax as much as the major axis Ax1 is inclined. Meanwhile, the output surface 314*c* of the translucent block 314 is formed of a flat surface that is significantly inclined downward from the vertical surface to which the optical axis Ax is orthogonal. The inclined angle of the output surface 314*c* is set such that the light output from the output surface 314*c* travels parallel to the optical axis Ax, which will be described below.

In the lighting device 310 for a vehicle, within the predetermined plane, the first reflection surface 14*a* reflects light from the light-emitting element 12 in the downwardly inclined direction, and the light is converged at the second focus B of the ellipse E located in a backwardly inclined direction. However, since the second reflection surface 14*b* is disposed between the first focus A and the second focus B of the ellipse E, the light is incident on the second reflection surface 14*b* before being converged at the second focus B. The cross-sectional shape of the second reflection surface 14*b* taken along the predetermined plane is the parabola P2 having the second focus B as its focus, and the point C located ahead of the focus B as its fixed point. Accordingly, the second reflection surface 214*b* reflects the light reflected by the first reflection surface 14*a* in a downwardly forward direction, thereby making the light become a light beam parallel to the axis Ax2 of the parabola P2. The light reflected by the second reflection surface 14*b* is refracted upward through the output surface 314*c*, thus being irradiated ahead of the lighting device in a state parallel to the optical axis Ax.

The same operational effects as that of the first embodiment can be achieved by disposing the output surface 314*c* to be inclined downward by a predetermined angle, even when the first reflection surface 14*a* and the second reflection surface 14*b* are disposed in a forwardly inclined direction as shown in the lighting device 310 for a vehicle according to the modification.

The same effects as that of the first embodiment can be achieved by disposing the output surface to be inclined upward by a predetermined angle, even when the first reflection surface and the second reflection surface are disposed in the backwardly inclined direction, in contrast to those of the lighting device 310 for a vehicle according to the modification.

The lighting device 10 according to the first embodiment can be disposed in the backwardly inclined direction or the forwardly inclined direction by changing its structure in part, as shown in the second and third modifications; accordingly, it is possible to increase the degree of freedom in the layout of the lighting device.

Hereinafter, a fourth modification of the embodiment will be described.

Figure 9:
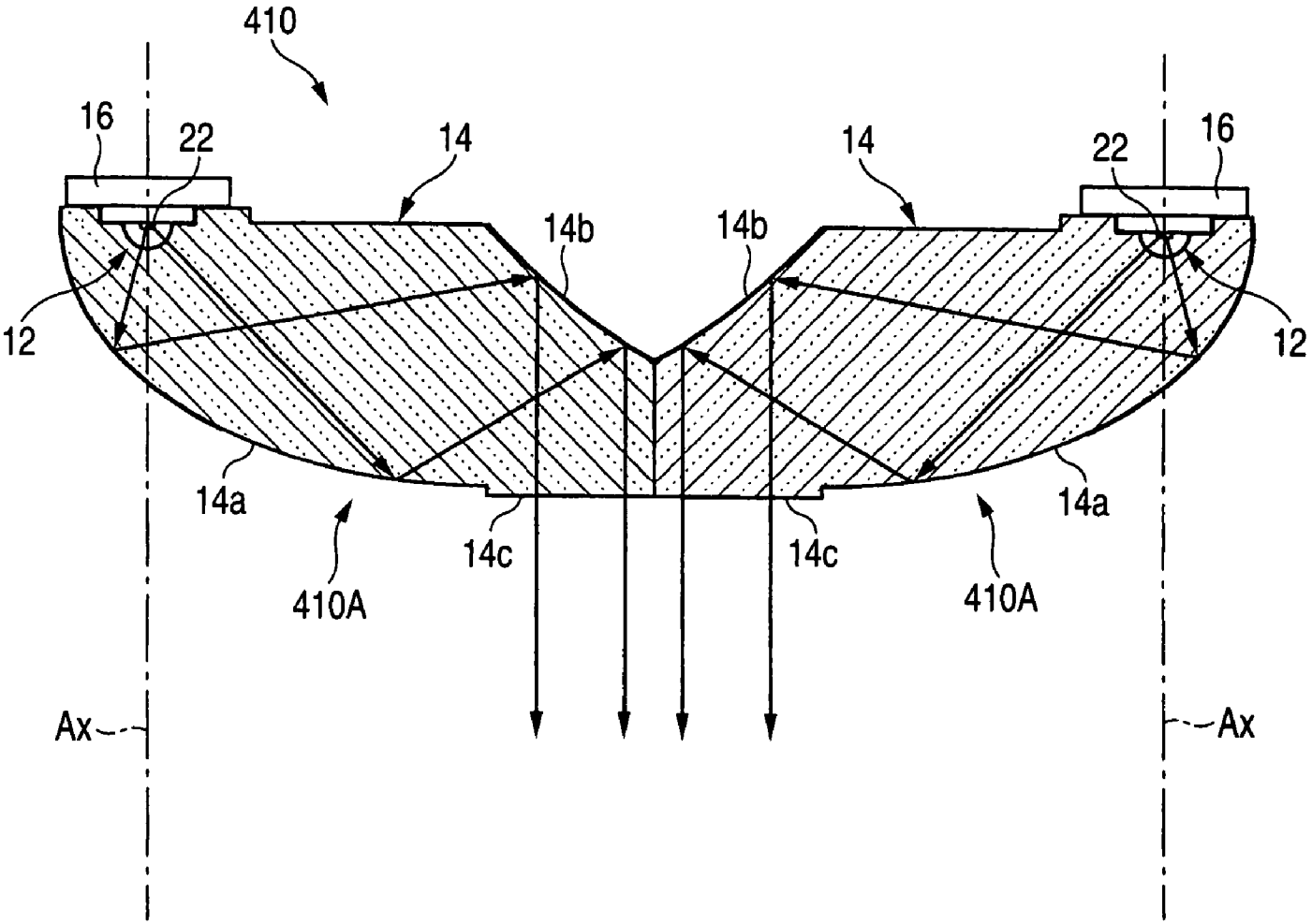
FIG. 9 is a cross-sectional plan view showing a lighting device according to a fourth modification of the embodiment.

FIG. 9 is a cross-sectional plan view showing a lighting device 410 according to the fourth modification of the embodiment.

As shown in FIG. 9, the lighting device 410 for a vehicle uses two lighting devices 410A having exactly the same configuration as the lighting device 10 for a vehicle according to the first embodiment, the two lighting devices 410A are transversely disposed to face each other at a lower edge surface of the translucent block 14.

In other words, the lighting device 410 for a vehicle has the configuration in which the output surface 14*c* of each lighting device 410A is transversely disposed to be adjacent to each other and has a vertically elongated rectangular shape when seen from the front view, and a pair of output surfaces 14*c* outputs light parallel to the optical axis Ax.

Figure 10:
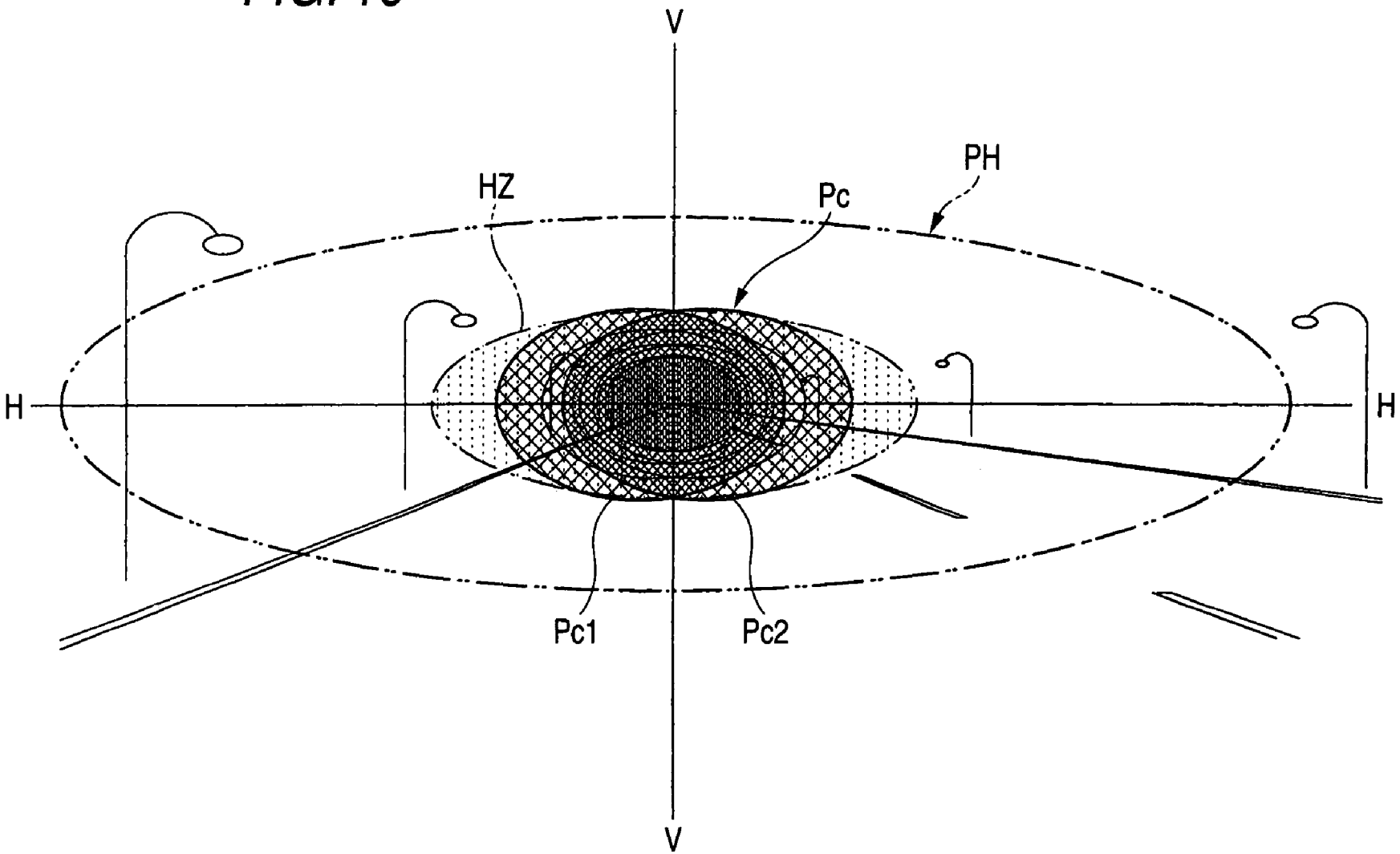
FIG. 10 is a perspective view showing a light distribution pattern formed onto the virtual vertical screen, when the lighting device for a vehicle according to the fourth modification irradiates light in the forward direction.

FIG. 10 is a perspective view showing a light distribution pattern Pc formed on the virtual vertical screen disposed 25 m ahead of the vehicle, when the lighting device 410 for a vehicle according to the fourth modification irradiates light in the forward direction.

As shown in FIG. 10, since the light distribution pattern Pc is formed by the light irradiated from the pair of lighting devices 410A symmetrically disposed, the light distribution pattern Pc is formed to be a synthetic light distribution pattern of a light distribution pattern Pc1 and a light distribution pattern Pc2. The light distribution pattern Pc1 is formed by rotating the light distribution pattern Pa of the first embodiment clockwise by 90 degrees with respect to H-V. The light distribution pattern Pc2 is formed by rotating the light distribution pattern Pa of the first embodiment counter-clockwise by 90 degrees with respect to H-V.

Each of the light distribution patterns Pc1 and Pc2 is formed in a transversely elongated spot shape with respect to H-V, and they are symmetrically formed. Therefore, the synthetic light distribution pattern Pc does not generate an uneven light distribution on a road surface ahead of the vehicle, and becomes a bright light distribution pattern suitable for forming the hot zone HZ of the high beam light distribution pattern PH.

Instead of the configuration in which the translucent blocks 14 of both lighting devices 410A are transversely disposed to face each other at the lower edge surface of the translucent block 14, as shown in the lighting device 410 for a vehicle according to the modification, the translucent blocks 14 of both lighting devices 410A can be formed into an integrated molding.

Hereinafter, a fifth modification of the first embodiment will be described.

Figure 11:
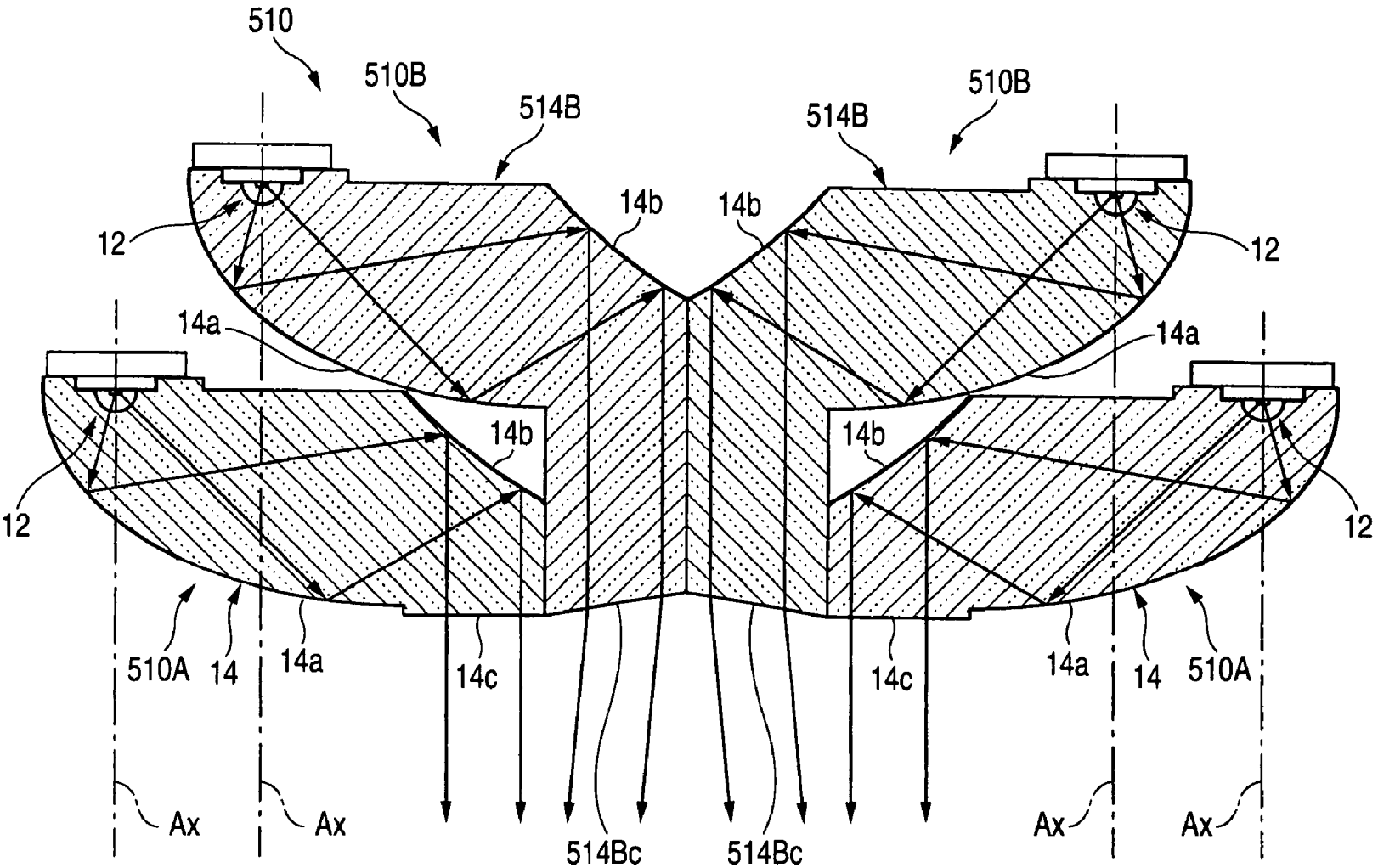
FIG. 11 is a cross-sectional plan view showing a lighting device according to a fifth modification of the embodiment.

FIG. 11 is a cross-sectional plan view showing a lighting device 510 according to a fifth modification of the embodiment.

As shown in FIG. 11, the lighting device 510 for a vehicle has the configuration in which a pair of lighting devices 510B, having about the same configuration as that of the lighting device 10 for a vehicle according to the first embodiment, are transversely disposed to face each other at a lower edge surface of a translucent block 514B, and a pair of lighting device 510A, having exactly the same configuration as that of the lighting device 10 for a vehicle according to the first embodiment, is transversely disposed ahead of the pair of lighting devices 510B.

Here, an output surface 514Bc of each lighting device 510B is separated in the forward direction from the second reflection surface 14*b* by a larger distance than the output surface 14*c* of each lighting device 510A that is separated in the forward direction from the second reflection surface 14*b*. Accordingly, the output surfaces 514Bc are evenly positioned along with the output surfaces 14*c*. However, while each output surface 14*c* is a surface taken along the vertical surface to which the optical axis Ax is orthogonal, each output surface 514Bc is a surface taken along a surface transversely inclined from the vertical surface to which the optical axis Ax is orthogonal.

Accordingly, in the lighting device 510 for a vehicle, the output surface 14*c* of each lighting device 510A outputs light parallel to the optical axis Ax, and the output surface 514Bc of each lighting device 510B outputs light parallel to an axis transversely deviated from the optical axis Ax.

Figure 12:
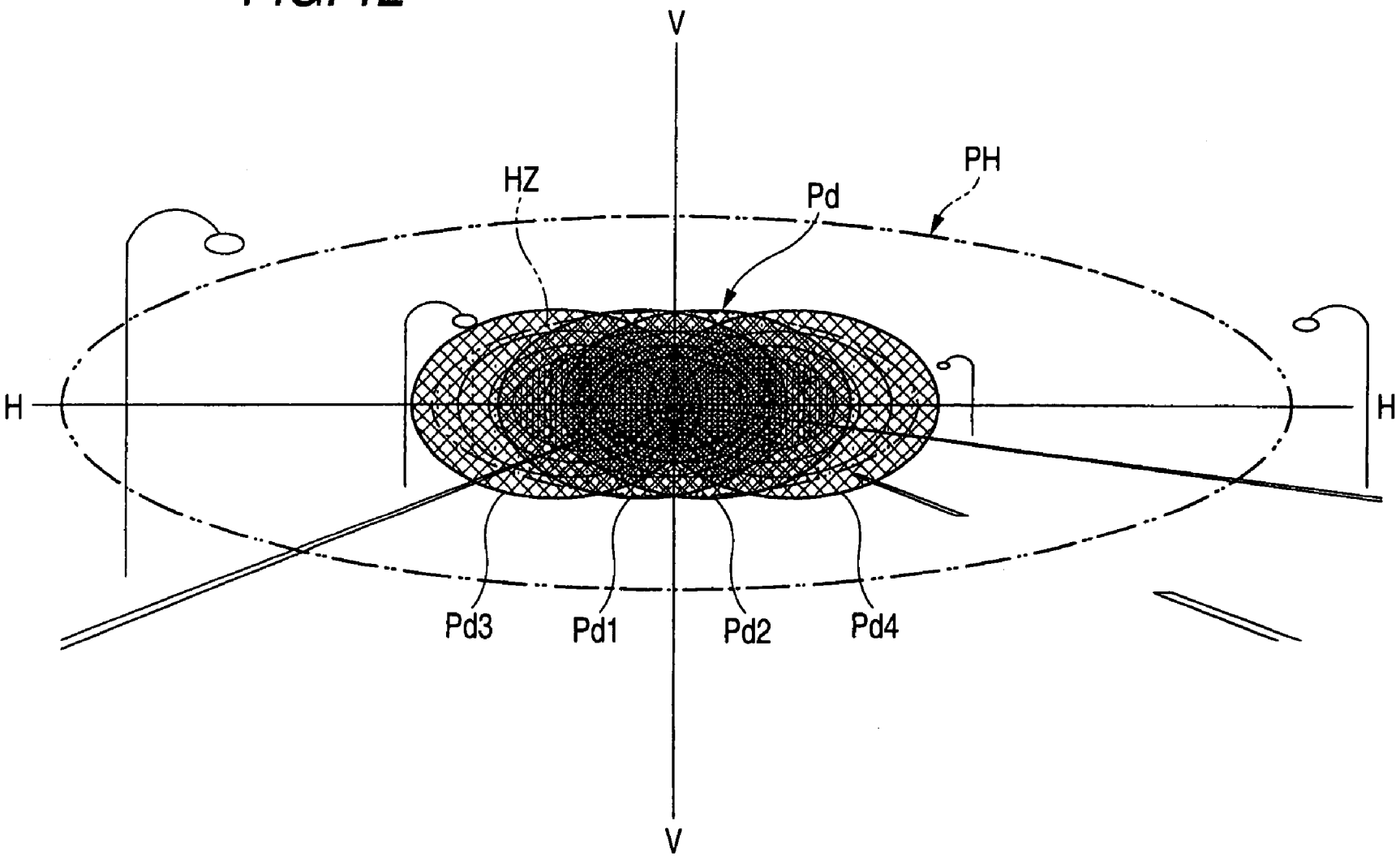
FIG. 12 is a perspective view showing a light distribution pattern formed onto the virtual vertical screen, when the lighting device for a vehicle according to the fifth modification irradiates light in the forward direction.

FIG. 12 is a perspective view showing a light distribution pattern Pd formed onto the virtual vertical screen disposed 25 m ahead of the vehicle, when the lighting device 510 for a vehicle according to the fifth modification irradiates light in the forward direction.

As shown in FIG. 12, the light distribution pattern Pd is formed to be a synthetic light distribution pattern of a pair of light distribution patterns Pd1 and Pd 2 and a pair of light distribution patterns Pd3 and Pd4. The pair of light distribution patterns Pd1 and Pd2 is formed by light irradiated by the pair of the lighting devices 510A. The pair of light distribution patterns Pd3 and Pd4 is formed by light irradiated by the pair of lighting devices 510B.

Each of the light distribution patterns Pd1 and Pd2 is formed in a transversely elongated spot shape with respect to H-V, and is symmetrically formed. Each of the light distribution patterns Pd3 and Pd4 is formed in a transversely elongated spot V, is symmetrically formed and is transversely deviated from the right and left side of each of the light distribution patterns Pd1 and Pd2, so as to have a transversely elongated spot shape with a symmetric arrangement. The synthetic light distribution pattern Pd of the four light distribution patterns Pd1, Pd2, Pd3 and Pd4 becomes a very bright light distribution pattern having the transversely elongated spot shape. Accordingly, the light distribution pattern Pd does not generate an uneven light distribution on a road surface ahead of the vehicle, and becomes suitable for forming the hot zone HZ of the high beam light distribution pattern PH.

In the lighting device 10 for a vehicle according to the present embodiment, the width in the forward and backward direction of the lighting device 10 can be made small; therefore, if a space for mounting the lighting device in the vehicle is sufficient in the forward and backward width, it is possible to superimpose each of the lighting devices 510A and 510B in the forward and backward direction. Further, it is possible to form a very bright light distribution pattern by using the configuration of the modification.

As shown in the modification, even though the output surface 514Bc of each lighting device 510B is separated in the forward direction from the second reflection surface 14*b* by a larger distance than the output surface 14*c* of each lighting device 510A that is separated in the forward direction from the second reflection surface 14*b*, the light from the second reflection surface 14*b* is incident on each of the output surfaces 14*c* and 514Bc in a parallel pattern. Therefore, the light distribution performance is prevented from deteriorating.

Hereinafter, a sixth modification of the first embodiment will be described.

Figure 13:
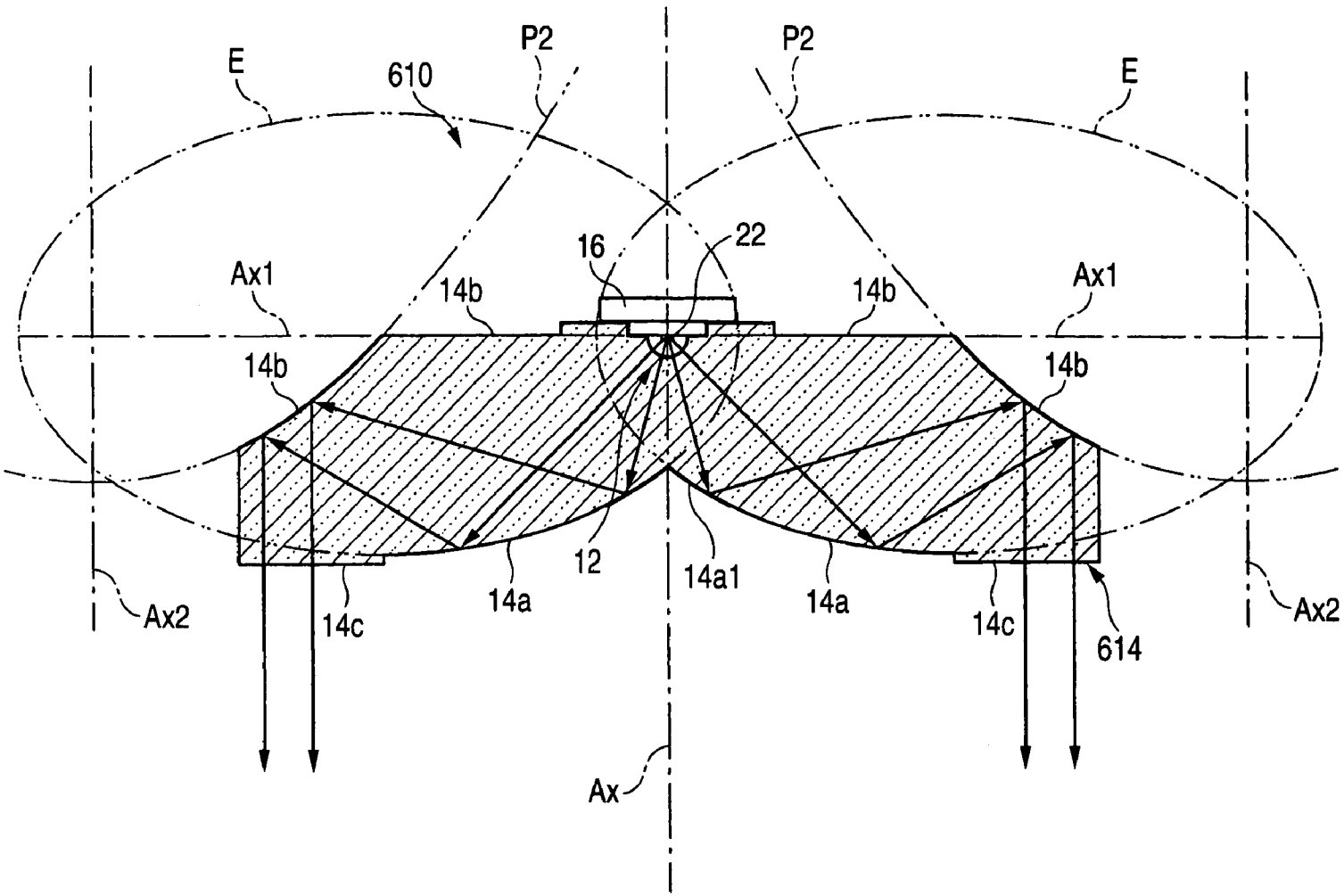
FIG. 13 is a cross-sectional plan view showing a lighting device according to a sixth modification of the embodiment.

FIG. 13 is a cross-sectional plan view showing a lighting device 610 according to a sixth modification.

As shown in FIG. 13, the translucent block 614 of the lighting device 610 for a vehicle has the configuration in which the translucent block 14 of the lighting device 10 for a vehicle according to the embodiment is symmetrically disposed on both sides of the optical axis Ax.

In the lighting device 610 for a vehicle, the pair of output surfaces 14*c* of the translucent block 614 outputs light parallel to the optical axis Ax.

Figure 14:
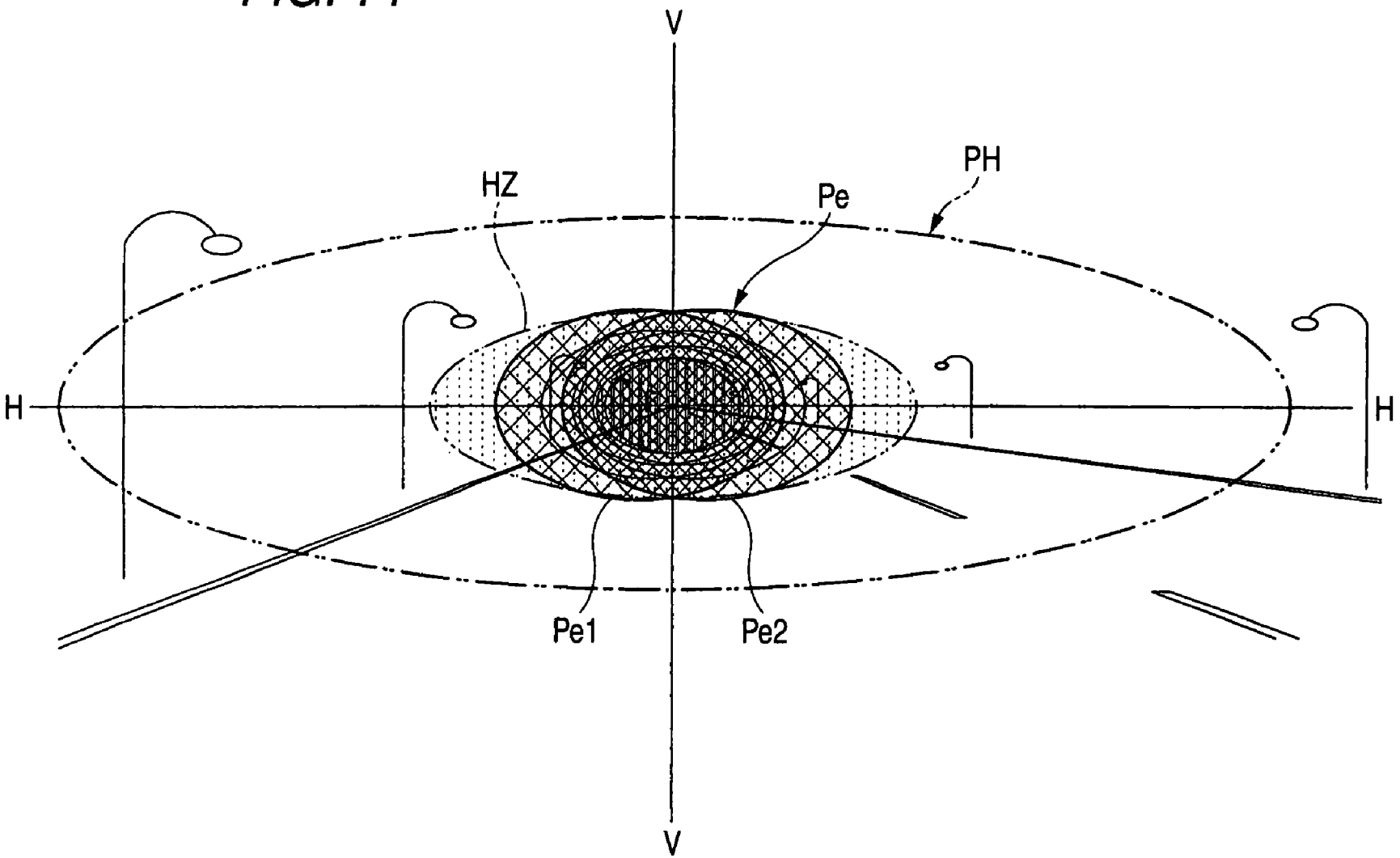
FIG. 14 is a perspective view showing a light distribution pattern formed onto the virtual vertical screen, when the lighting device for a vehicle according to the sixth modification irradiates light in the forward direction.

FIG. 14 is a perspective view showing a light distribution pattern Pe formed onto the virtual vertical screen disposed 25 m ahead of the vehicle, when the lighting device 410 for a vehicle according to the sixth modification irradiates light in the forward direction.

As shown in FIG. 14, the light distribution pattern Pe is formed to be a synthetic light distribution pattern of light distribution patterns Pe1 and Pe 2 formed by light output from the pair of output surfaces 14*c* on both sides of the optical axis. The light distribution pattern Pe becomes substantially the same light distribution pattern Pc shown in FIG. 10, but the light distribution pattern Pe is formed by light from the single light-emitting element 12. Therefore, the light distribution pattern Pe becomes a light distribution pattern that is darker throughout the pattern than the light distribution pattern Pc.

Using the lighting device 610 for a vehicle according to the modification, the single light-emitting element 12 can form symmetric light distribution patterns having a spot shape that is transversely elongated with respect to H-V. Accordingly, the light distribution pattern Pe does not generate an uneven light distribution on a road surface ahead of the vehicle, and it is possible to achieve a light distribution pattern suitable for forming the hot zone HZ of the high beam light distribution pattern PH.

Hereinafter, a second embodiment according to the invention will be described.

Figure 15:
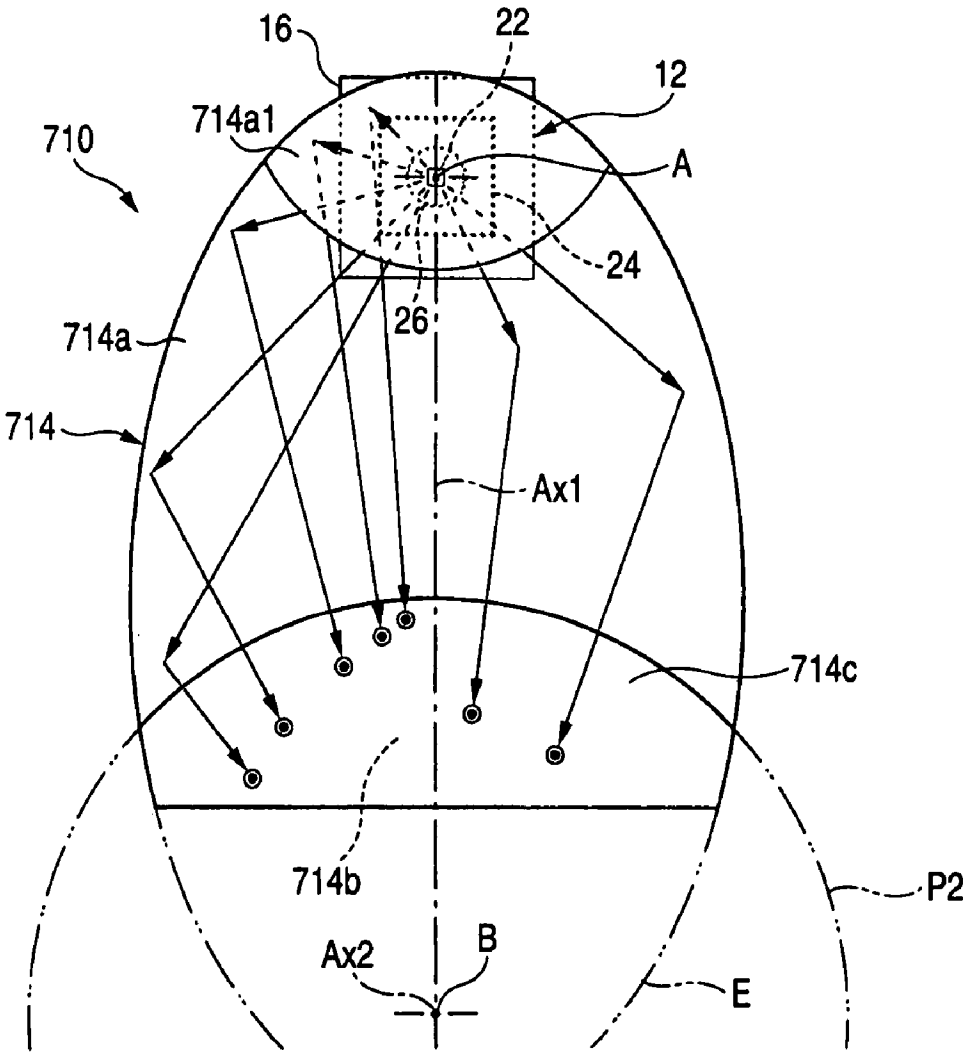
FIG. 15 is a front view showing a lighting device according to a second embodiment of the invention.

FIG. 15 is a front view showing a lighting device 710 according to a second embodiment of the invention.

As shown in FIG. 15, the lighting device 710 for a vehicle has the same configuration as the lighting device 10 for a vehicle according to the first embodiment in its fundamental structure. However, the lighting device 710 for a vehicle has differences from the first embodiment in the surface shape of a first reflection surface 714*a* and a second reflection surface 714*b* of a translucent block 714 and an external shape of an output surface 714*c*.

That is, the first reflection surface 714*a* is formed of a rotary elliptic surface in which the major axis Ax1 of the ellipse E forming the cross-sectional shape taken along the predetermined plane of the first reflection surface 14*a* according to the first embodiment is set to be a central axis. In addition, the second reflection surface 714*b* is formed of a rotary parabolic surface in which the axis Ax2 of the parabola P2 forming the cross-sectional shape taken along the predetermined plane of the second reflection surface 14*b* according to the first embodiment is set to be a central axis. Accordingly, the output surface 714*c* is formed in a curve shape at its upper edge and both side edges.

In the same way as the upper region 14*a*1 of the first reflection surface 14*a* according to the first embodiment, an upper region 714*a*1 of the first reflection surface 714*a* is treated with mirror finishing, such as aluminum deposition.

Figure 16:
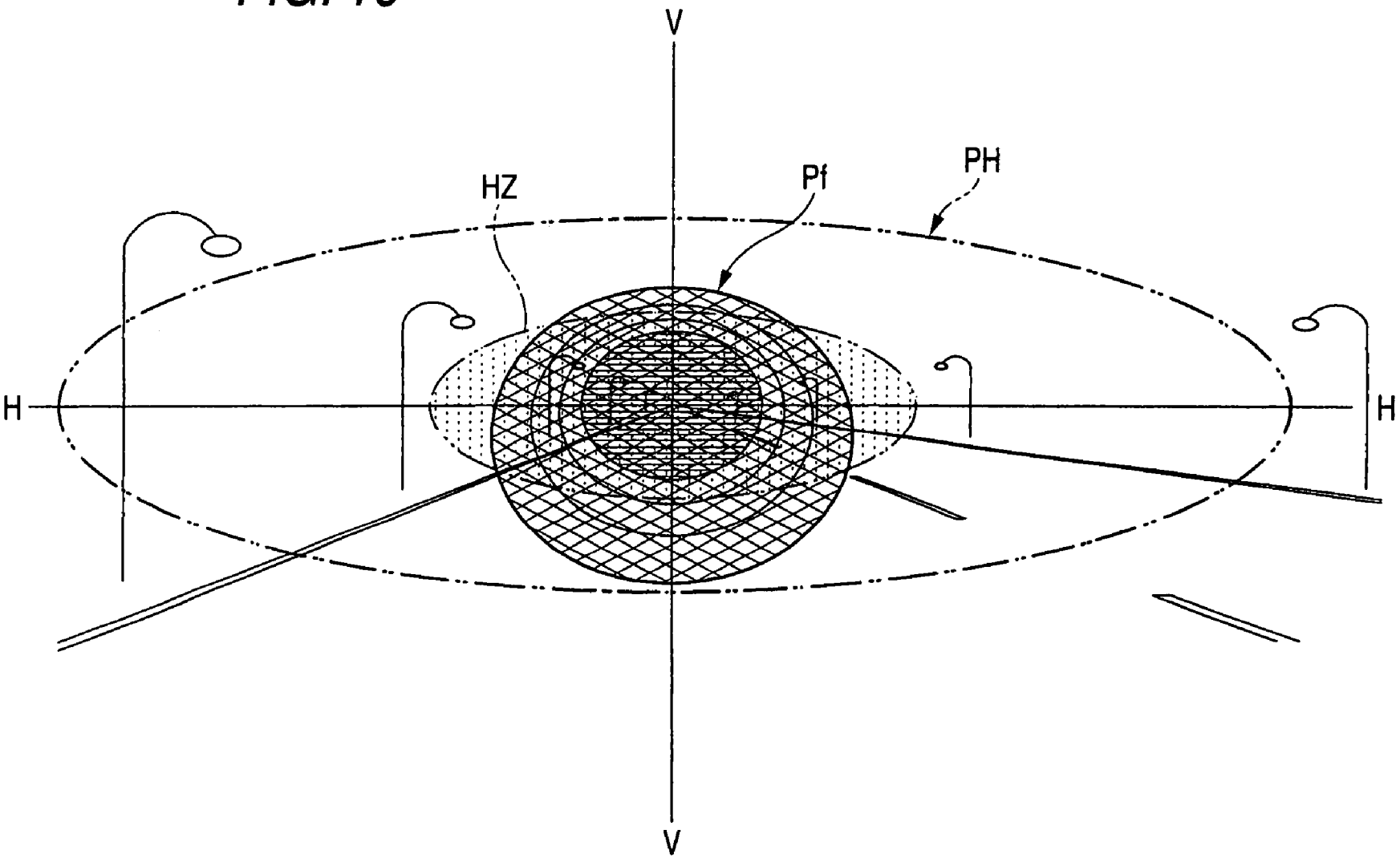
FIG. 16 is a perspective view showing a light distribution pattern formed onto the virtual vertical screen, when the lighting device for a vehicle according to the second embodiment irradiates light in the forward direction.

As well in the lighting device 710 for a vehicle, the output surface 714*c* outputs light parallel to the optical axis Ax FIG. 16 is a perspective view showing a light distribution pattern Pf formed onto the virtual vertical screen disposed 25 m ahead of the vehicle, when the lighting device 710 for a vehicle according to the second embodiment irradiates light in the forward direction.

As shown in FIG. 16, the light distribution pattern Pf is formed in a spot shape with respect to H-V, its lower portion shows more gradual difference in luminous intensity distribution than its upper portion. Here, the light distribution pattern Pf is a transversely spread light distribution pattern, as compared to the light distribution pattern Pa formed in the first embodiment. This is because the first reflection surface 14*a* is formed of a rotary elliptic surface and the second reflection surface 714*b* is formed of a rotary parabolic surface.

Even when the lighting device 710 for a vehicle according to the second embodiment is used, it is possible to form a bright light distribution pattern suitable for forming the hot zone HZ of the high-beam light distribution pattern PH.

The lighting device 710 for a vehicle according to the second embodiment has exactly the same cross-sectional shape taken along the predetermined surface as that of the lighting device 10 for a vehicle according to the first embodiment. Therefore, even when the lighting device 710 for a vehicle according to the second embodiment is used, the width in the forward and backward direction of the lighting device can be made small by increasing the utilization rate of light flux from the light-emitting element 12.

Moreover, as the lighting device 710 for a vehicle according to the second embodiment is used, the width in the transverse direction of the lighting device can be made smaller than that of the lighting device 10 according to the first embodiment.

Hereinafter, a third embodiment according to the invention will be described.

Figure 17:
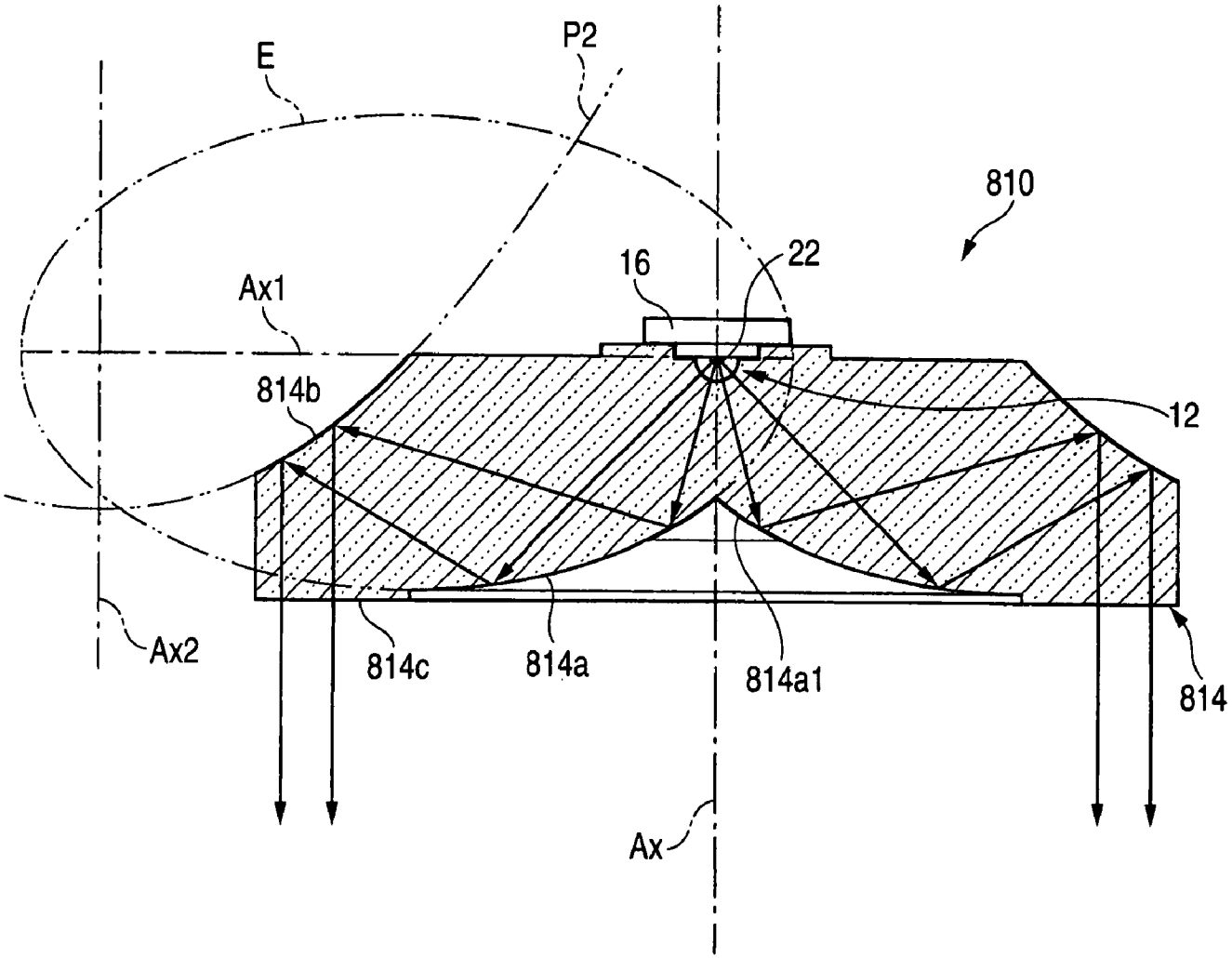
FIG. 17 is a cross-sectional plan view showing a lighting device according to a third embodiment of the invention.

FIG. 17 is a cross-sectional plan view showing a lighting device 810 for a vehicle according to the third embodiment of the invention.

As shown in FIG. 17, a translucent block 814 of the lighting device 810 for a vehicle has the same horizontal cross-sectional shape as that of the translucent block 614 of the lighting device 610 for a vehicle according to the sixth modification of the first embodiment, and has a rotary body formed as the horizontal cross-sectional shape is rotated around the optical axis Ax.

That is, a first reflection surface 814*a* of the translucent block 814 is formed of a curved surface formed as the ellipse E forming the cross-sectional shape of the predetermined plane is rotated around the optical axis Ax. A second reflection surface 814*b* is formed of a curved surface formed as the parabola P2 forming the cross-sectional shape of the predetermined surface is rotated around the optical axis Ax. An output surface 814*c* is formed of a circular ring shaped surface taken along the vertical surface to which the optical axis Ax is orthogonal.

In the same way as the upper region 14*a*1 of the first reflection surface 14*a* according to the first embodiment, an optical axis vicinity region 814*a*1 of the first reflection surface 814*a* is treated with mirror finishing, such as aluminum deposition.

Figure 18:
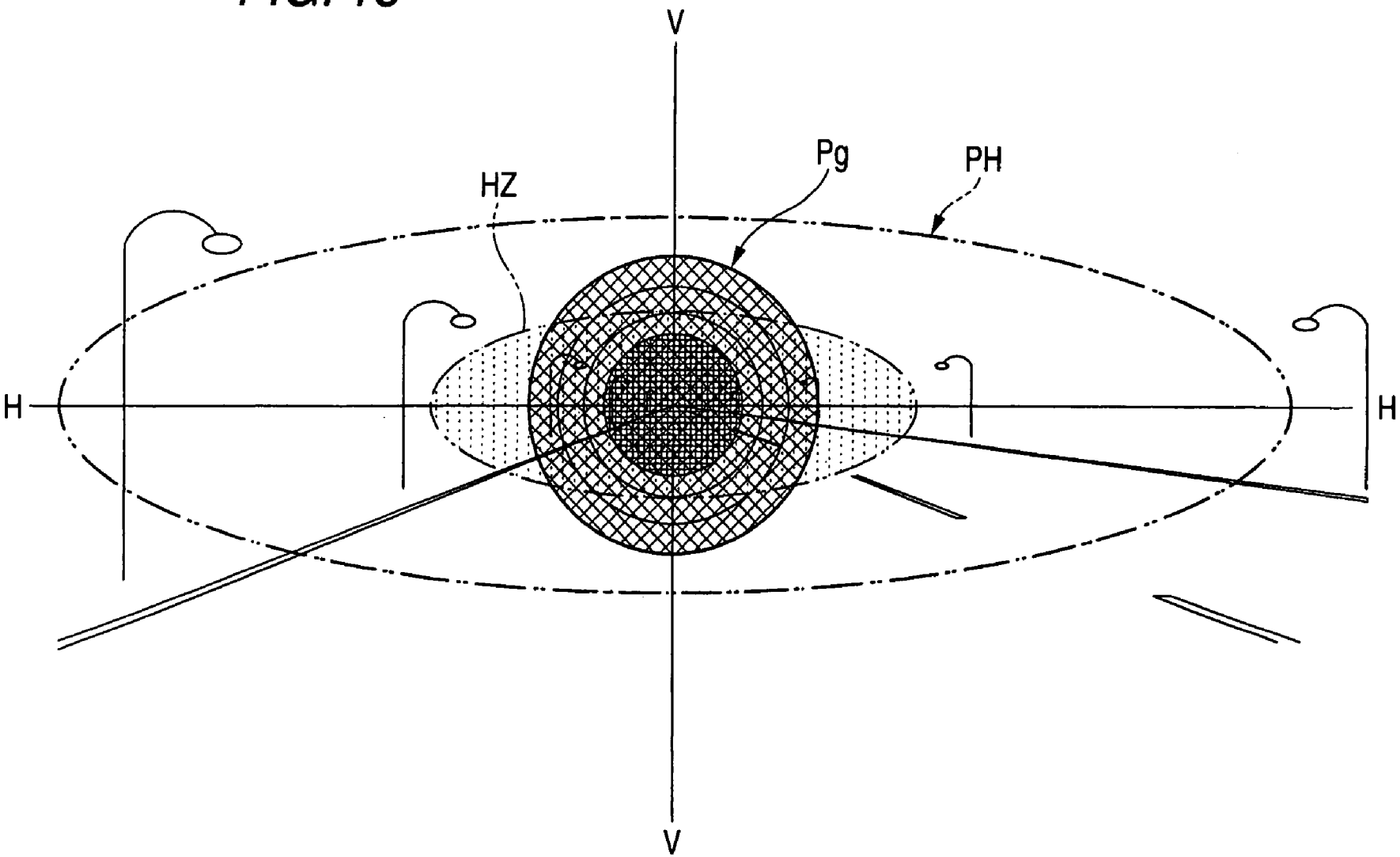
FIG. 18 is a perspective view showing a light distribution pattern formed onto the virtual vertical screen, when the lighting device for a vehicle according to the third embodiment irradiates light in the forward direction.

FIG. 18 is a perspective view showing a light distribution pattern Pg formed onto the virtual vertical screen disposed 25 m ahead of the vehicle, when the lighting device 810 for a vehicle according to the third embodiment irradiates light in the forward direction.

As shown in FIG. 18, the light distribution pattern Pg is formed in a spot shape with respect to H-V, and has balanced luminous intensity distribution along the entire periphery of the pattern. This is because the first reflection surface 814*a* and the second reflection surface 814*b* have the rotary body shape whose central axis is the optical axis Ax.

When the lighting device 810 for a vehicle according to the second embodiment is used, it is possible to form a bright light distribution pattern suitable for forming the hot zone HZ of the high-beam light distribution pattern PH.

The lighting device 810 for a vehicle according to the second embodiment has the same width in the forward and backward direction as that of the lighting device 10 for a vehicle according to the first embodiment. Therefore, even when the lighting device 810 for a vehicle according to the second embodiment is used, the width in the forward and backward direction of the lighting device can be made small by increasing the utilization rate of light flux from the light-emitting element 12.

It will be apparent to those skilled in the art that various modifications and variations can be made to the described embodiments of the present invention disclosed in the specification without departing from the spirit or scope of the invention. Thus, it is intended that the present invention cover all modifications and variations of this invention consistent with the scope of the appended claims and their equivalents.

I claim:

1. A lighting device for a vehicle, comprising:

a light-emitting element disposed on an optical axis extending in a forward and backward direction of the lighting device;

a first reflection surface for reflecting light emitted from the light-emitting element in an outer radial direction of the optical axis; and a second reflection surface for reflecting the light emitted from the light-emitting element and reflected by the first reflection surface in the forward direction, wherein a cross-sectional shape of the first reflection surface taken along a first plane including the optical axis is an ellipse, the ellipse having a light-emitting center of the light-emitting element as a first focus and an axis line crossing the optical axis as a major axis, the second reflection surface is disposed between the first focus and a second focus of the ellipse, a cross-sectional shape of the second reflection surface taken along the first plane is a parabola having the second focus of the ellipse as a focus and a point located in the forward direction of the focus as a vertex, and a cross-sectional shape of the second reflection surface taken along a second plane perpendicular to the optical axis is rectangular.

2. The lighting device according to claim 1, wherein the first and second reflection surfaces are formed on the surface of a single translucent block.

3. A lighting device for a vehicle, comprising:

a light-emitting element disposed on an optical axis extending in a forward and backward direction of the lighting device;

a first reflection surface for reflecting light emitted from the light-emitting element in an outer radial direction of the optical axis; and a second reflection surface for reflecting the light emitted from the light-emitting element and reflected by the first reflection surface in the forward direction, wherein a cross-sectional shape of the first reflection surface taken along a predetermined plane including the optical axis is an ellipse, the ellipse having a light-emitting center of the light-emitting element as a first focus and an axis line crossing the optical axis as a major axis, the second reflection surface is disposed between the first focus and a second focus of the ellipse, a cross-sectional shape of the second reflection surface taken along the predetermined plane is a parabola having the second focus of the ellipse as a focus and a point located in the forward direction of the focus as a vertex, and a cross-sectional shape of the first reflection surface, which is taken along a plane including the major axis of the ellipse and orthogonal to the predetermined plane, is a parabola having the light-emitting center of the light-emitting element as a focus, and the second reflection surface is a parabolic surface, which includes the focus of the parabola and has an axis line orthogonal to the predetermined plane as a focal line.

4. The lighting device according to claim 3, wherein the first and second reflection surfaces are formed on the surface of a single translucent block.

* * * * *